US009315356B2

(12) United States Patent
Yoshida et al.

(10) Patent No.: US 9,315,356 B2
(45) Date of Patent: Apr. 19, 2016

(54) SHEET PROCESSING APPARATUS HAVING BINDING UNIT AND IMAGE FORMING SYSTEM THEREOF

(71) Applicants: Ryuji Yoshida, Kanagawa (JP); Nobuyoshi Suzuki, Tokyo (JP); Shingo Matsushita, Tokyo (JP); Katsuhiro Kosuge, Kanagawa (JP); Yuusuke Shibasaki, Kanagawa (JP); Wataru Takahashi, Kanagawa (JP); Takashi Saito, Kanagawa (JP); Akihiro Musha, Kanagawa (JP); Takuya Morinaga, Tokyo (JP); Ikuhisa Okamoto, Kanagawa (JP); Nagayasu Yoshida, Kanagawa (JP); Hirotaka Hayashi, Kanagawa (JP)

(72) Inventors: Ryuji Yoshida, Kanagawa (JP); Nobuyoshi Suzuki, Tokyo (JP); Shingo Matsushita, Tokyo (JP); Katsuhiro Kosuge, Kanagawa (JP); Yuusuke Shibasaki, Kanagawa (JP); Wataru Takahashi, Kanagawa (JP); Takashi Saito, Kanagawa (JP); Akihiro Musha, Kanagawa (JP); Takuya Morinaga, Tokyo (JP); Ikuhisa Okamoto, Kanagawa (JP); Nagayasu Yoshida, Kanagawa (JP); Hirotaka Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 86 days.

(21) Appl. No.: 14/072,956

(22) Filed: Nov. 6, 2013

(65) Prior Publication Data

US 2014/0138896 A1 May 22, 2014

(30) Foreign Application Priority Data

Nov. 19, 2012 (JP) ..... 2012-253773
Nov. 22, 2012 (JP) ..... 2012-256380
Jul. 2, 2013 (JP) ..... 2013-139220

(51) Int. Cl.
*B65H 37/04* (2006.01)
*B31F 5/02* (2006.01)
*B42B 5/00* (2006.01)
*G03G 15/00* (2006.01)

(52) U.S. Cl.
CPC *B65H 37/04* (2013.01); *B31F 5/02* (2013.01); *B42B 5/00* (2013.01); *G03G 15/6544* (2013.01); *B65H 2301/51616* (2013.01); *B65H 2801/27* (2013.01); *G03G 2215/00848* (2013.01)

(58) Field of Classification Search
CPC ..... B65H 37/04
USPC ..... 270/58.07, 58.08; 399/407, 408
See application file for complete search history.

(56) References Cited

U.S. PATENT DOCUMENTS 2,188,222 A 1/1940 Hibbs
8,899,568 B2 * 12/2014 Matsushita et al. ..... 270/58.08

(Continued)

FOREIGN PATENT DOCUMENTS

| | | |
|---|---|---|
| EP | 2465693 A1 | 6/2012 |
| JP | S36-13206 | 5/1961 |
| JP | S37-7208 | 4/1962 |
| JP | H07-165365 | 6/1995 |
| JP | 2004-105974 | 4/2004 |

(Continued)

OTHER PUBLICATIONS

Extended European Search Report dated Dec. 5, 2014 issued in corresponding European Application No. 13191291.7.

*Primary Examiner* — Patrick Mackey
(74) *Attorney, Agent, or Firm* — Harness, Dickey & Pierce, P.L.C.

(57) ABSTRACT

According to an aspect of an embodiment, a sheet processing apparatus includes: a conveying unit configured to convey sheets; a stacking unit configured to stack the conveyed sheets to form a sheet stack; and a binding unit configured to include a pair of toothed jaw and bind the sheet stack by pressing the sheet stack between the pair of toothed jaw, wherein at least one portion of edges of the toothed jaw is rounded.

17 Claims, 28 Drawing Sheets

(56) References Cited

U.S. PATENT DOCUMENTS

| | | | | |
|---|---|---|---|---|
| 8,991,808 | B2 | 3/2015 | Suzuki et al. | |
| 2005/0257910 | A1 | 11/2005 | Boatman et al. | |
| 2010/0202814 | A1* | 8/2010 | Nakamura | 399/408 |
| 2012/0148372 | A1* | 6/2012 | Mori | B42B 5/00 412/33 |
| 2013/0001848 | A1 | 1/2013 | Hidaka et al. | |
| 2013/0011219 | A1 | 1/2013 | Musha et al. | |
| 2013/0154178 | A1 | 6/2013 | Suzuki et al. | |
| 2013/0270762 | A1* | 10/2013 | Saito et al. | 270/58.08 |
| 2014/0138896 | A1* | 5/2014 | Yoshida et al. | 270/58.11 |

FOREIGN PATENT DOCUMENTS

| | | | |
|---|---|---|---|
| JP | 2007-536141 | | 12/2007 |
| JP | 2009-031489 | | 2/2009 |
| JP | 2010184769 | A | 8/2010 |
| JP | 2010-208854 | | 9/2010 |
| JP | 2010-274623 | | 12/2010 |
| JP | 2010274623 | A * | 12/2010 |
| JP | 2011-201652 | | 10/2011 |
| JP | 2013-252695 | A | 12/2013 |
| WO | WO2009-110298 | | 9/2009 |

* cited by examiner (A)

(B)

(A)

(B)

(A)

(B)

(A)

(B)

(A)

(B)

(A)

(B)

(A)

(B)

(A)

(B)

SHEET PROCESSING APPARATUS HAVING BINDING UNIT AND IMAGE FORMING SYSTEM THEREOF

CROSS-REFERENCE TO RELATED APPLICATIONS

The present application claims priority to and incorporates by reference the entire contents of Japanese Patent Application No. 2012-253773 filed in Japan on Nov. 19, 2012, Japanese Patent Application No. 2012-256380 filed in Japan on Nov. 22, 2012 and Japanese Patent Application No. 2013-139220 filed in Japan on Jul. 2, 2013.

BACKGROUND OF THE INVENTION

1. Field of the Invention

The present invention relates generally to a sheet processing apparatus and an image forming system and, more particularly, to a binding mechanism for media sheets, on which images are formed.

2. Description of the Related Art

Postprocessing, such as binding using a stapler, is performed on a stack of a certain number of sheets of printout produced by an image forming apparatus in some cases where the printout sheets are not directly ejected from the image forming apparatus. Examples of the image forming apparatus include a copier, a printer, and a printing apparatus. As a device for this purpose, a sheet processing apparatus connected to a sheet ejecting unit of the image forming apparatus is typically employed.

Although binding using staples is popularly performed, devices that do not consume metal items, such as staples, have been desired in recent years from the viewpoint of resources saving, ecology, and recyclability.

Examples of such a device include binding devices disclosed in Japanese Laid-open Patent Application No. 2010-208854 and published Japanese translation of a PCT application 2007-536141. The binding devices bind a stack of sheets together by applying deep-nested embossment on the sheet stack using toothed jaws capable of pinching and pressing the sheet stack.

In a conventional configuration for binding, a top land of a toothed jaw has what is referred to as a sharp-edged corner, which is a corner shaped like a ridge formed with intersecting straight lines. Accordingly, there can arise a problem that when such toothed jaws are brought into mesh to perform binding, they can undesirably cut fibers of paper, whereby binding strength is decreased.

Meanwhile, disclosed in published Japanese translation of a PCT application 2007-536141 is forming rounded ridges on corners of top lands of protrusions for use in embossing.

However, this configuration adopts round corner edges, each approximating an arc shape obtained by removing a corner edge with one or more straight lines or an irregular cut line, in order to increase wet burst strength of a product, such as tissue paper.

Meanwhile, making sheets incapable of recovering to their original shape by bending and permanently deforming a corner of ridged-and-grooved surfaces can be one of measures for preventing sheets that are bound by deep-nested embossing from becoming apart.

From this standpoint, the configuration disclosed in published Japanese translation of a PCT application 2007-53614 focuses only on an aspect that the wet burst strength of a product is affected by an embossment height, and does not consider about preventing a decrease in binding strength by preventing bound sheets from recovering to their original shape.

In light of the problem pertaining to the conventional sheet processing apparatuses, there is a need for a sheet processing apparatus configured to be capable of binding sheets by applying deep-nested embossment without causing fiber breakage of the sheets.

It is an object of the present invention to at least partially solve the problem in the conventional technology.

SUMMARY OF THE INVENTION

It is an object of the present invention to at least partially solve the problems in the conventional technology.

According to the present invention, there is provided: a sheet processing apparatus comprising: a conveying unit configured to convey sheets; a stacking unit configured to stack the conveyed sheets to form a sheet stack; and a binding unit configured to include a pair of toothed jaw, and bind the sheet stack by pressing the sheet stack between the pair of toothed jaw, wherein at least one portion of edges of the toothed jaw is rounded.

The present invention also provides a sheet processing apparatus comprising: a conveying unit configured to convey sheets; a stacking unit configured to stack the conveyed sheets to form a sheet stack; and a binding unit configured to include a pair of toothed jaw, and bind the sheet stack by pressing the sheet stack between the pair of toothed jaw, wherein at least one portion of edges of the toothed jaw is chamfered.

The present invention also provides a sheet processing apparatus comprising: a binding unit configured to include a pair of toothed jaw, and bind a sheet stack by pressing the sheet stack between the pair of toothed jaw, wherein at least one portion of edges of the toothed jaw is rounded.

The present invention also provides an image forming system comprising the sheet processing apparatus according to any one of the above-mention sheet processing apparatuses.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A feature of an embodiment of the present invention lies in the configuration for preventing a media sheet or the like from being wrinkled or torn, which can occur during sheet binding, thereby lessening a decrease in binding strength. Hereinafter, a media sheet and a stack of media sheets are referred to as "sheet" and "sheet stack", respectively.

An exemplary embodiment of the present invention is described below with reference to examples illustrated in the accompanying drawings.

Before describing features of the embodiments, configurations and operations of a sheet processing system, to which the embodiment is to be applied, are described below.

FIGS. 1(A) and 1(B) are diagrams illustrating two forms of an image forming system according to an embodiment of the present invention. An image forming system 100 according to the embodiment includes an image forming apparatus 101 and a sheet processing apparatus (finisher) 201.

The sheet processing apparatus 201 is a so-called conveying-path binding device, which is a binding device arranged on a conveying path along which sheets are conveyed from the image forming apparatus 101.

FIG. 1(A) illustrates a form, in which the sheet processing apparatus 201 is mounted on the conveying path in the image forming apparatus 101. FIG. 1(B) illustrates a form, in which the sheet processing apparatus 201 is mounted outside the conveying path of the image forming apparatus 101.

The sheet processing apparatus 201 has an aligning function of overlaying sheets on one another to form a sheet stack and aligning the sheets on the conveying path, and a binding function of binding the sheet stack on the conveying path.

The sheet processing apparatus 201 of the form illustrated in FIG. 1(A) is also referred to as an internal processing apparatus because postprocessing is performed inside a body of the image forming apparatus 101.

The image forming apparatus 101 includes an image-forming engine unit 101A that includes an image processing unit and a sheet feed unit, a read engine unit 103 that reads an image and converts it into image data, and an automatic document feeder (ADF) 104 that automatically feeds an original document to be read to the read engine unit 103.

A sheet ejecting unit is arranged as follows. In the configuration illustrated in FIG. 1(A), the sheet ejecting unit is arranged so as to eject a sheet, on which an image is formed, inside the body of the image forming apparatus 101. In the arrangement illustrated in FIG. 1(B), the sheet ejecting unit is arranged so as to eject a sheet, on which an image is formed, to the outside of the image forming apparatus 101.

Figure 1:
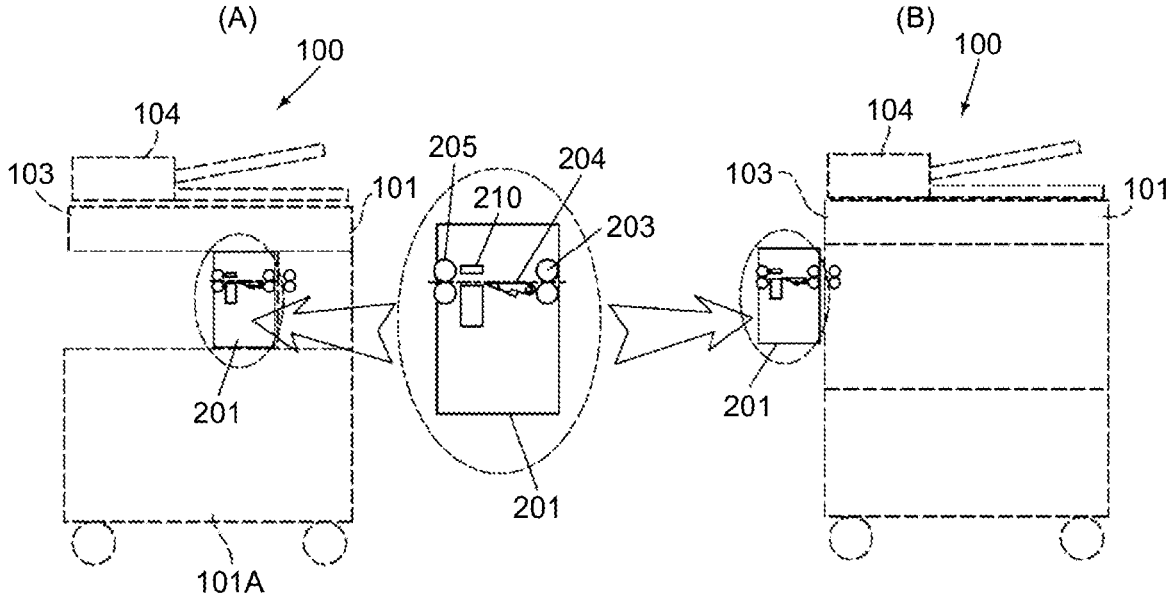
FIGS. 1(A) and 1(B) are schematic diagrams for describing configurations of an image forming system including an image forming apparatus that uses a sheet processing apparatus according to an embodiment of the present invention.
Figure 2:
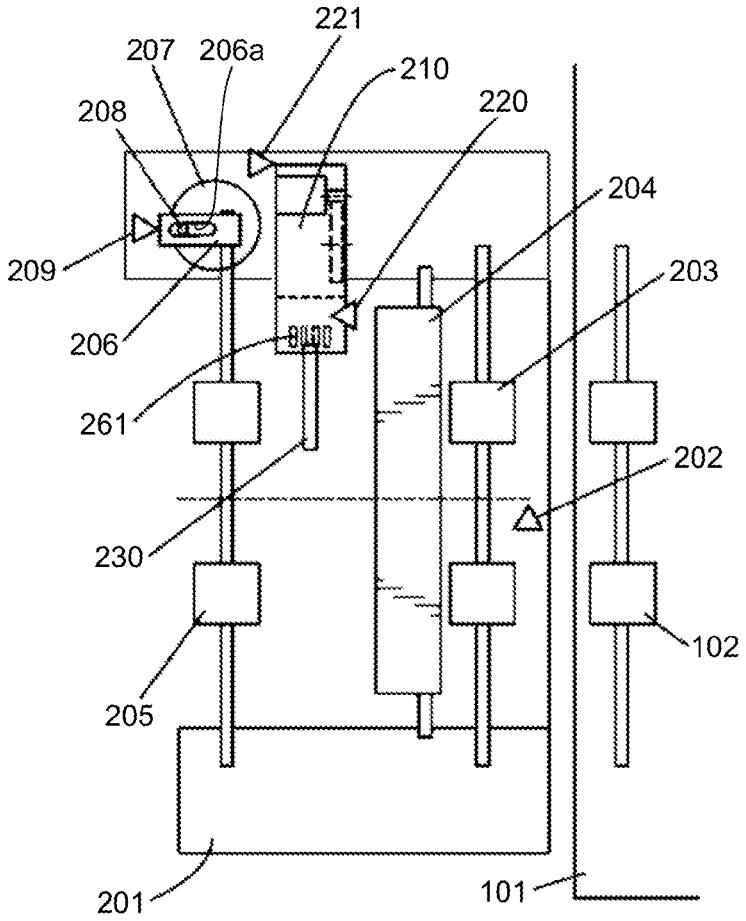
FIG. 2 is a plan view illustrating an example of the sheet processing apparatus according to the embodiment.
Figure 3:
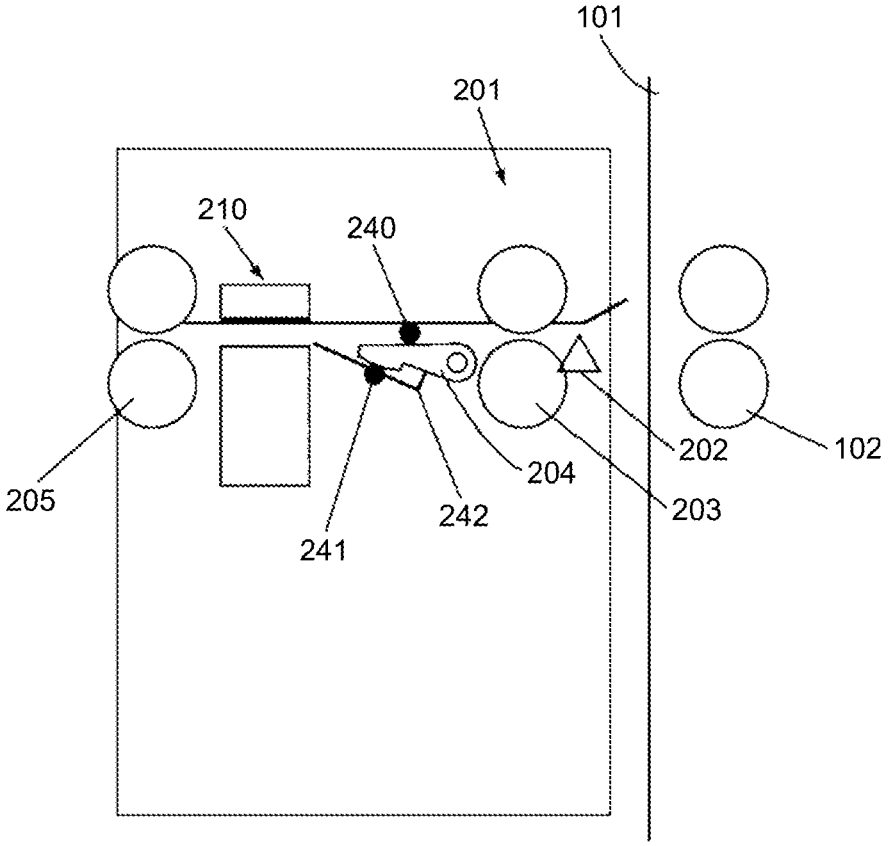
FIG. 3 is a front view illustrating the example of the sheet processing apparatus illustrated in FIG. 2.

FIG. 2 is a plan view of the sheet processing apparatus 201 illustrated in FIG. 1. FIG. 3 is a front view of the same.

Referring to FIGS. 2 and 3, the sheet processing apparatus 201 includes an entry sensor 202, an entry roller 203, a bifurcating claw 204, a binding tool 210 corresponding to a deep-nested embossing mechanism, and a sheet ejecting roller 205 arranged in this order along a sheet conveying path 240 from an entrance side.

The entry sensor 202 detects a leading end, a trailing end, and presence/absence of a sheet ejected by sheet ejecting rollers 102 of the image forming apparatus 101 and conveyed into the sheet processing apparatus 201.

A photosensor of reflection type is used as the entry sensor 202, for example. A photosensor of transmission type can be used in lieu of the photosensor of reflection type.

The entry roller 203 at the entrance of the sheet processing apparatus 201 has a function of receiving a sheet ejected by the sheet ejecting rollers 102 of the image forming apparatus 101 and conveying the sheet into a binding position where deep-nested embossment is to be applied. The entry roller 203 also includes a driving source (driving motor) of which running, stopping, and conveyance distance are controllable using a control unit (not shown).

The entry roller 203 also performs skew correction by receiving and contacting the leading end of the sheet conveyed from the image forming apparatus 101 at a nip between the entry roller 203 and another roller, which form a pair.

The bifurcating claw 204 is arranged downstream of the entry roller 203.

Referring to FIG. 3, the bifurcating claw 204 is provided to guide the trailing end of the sheet to a branch path 241. In this case, after the trailing end of the sheet has past over the bifurcating claw 204, the bifurcating claw 204 swings clockwise in FIG. 3 to convey the sheet in a direction opposite to the sheet incoming direction. As a result, the trailing end of the sheet is introduced to the branch path 241. The bifurcating claw 204, which will be described later, is driven by a solenoid so as to swing.

A motor can be used in lieu of the solenoid. The bifurcating claw 204 is capable of, when driven to swing counterclockwise in FIG. 3, pressing a sheet or a sheet stack against a conveying surface of the branch path 241. By doing so, the bifurcating claw 204 can hold the sheet or the sheet stack on the branch path 241 where the sheet or the sheet stack can be accumulated.

The sheet ejecting roller 205 is arranged immediately upstream of an exit of the conveying path 240 of the sheet processing apparatus 201 and has functions of conveying, shifting, and ejecting the sheet. As does the entry roller 203, the sheet ejecting roller 205 includes a driving source (driving motor) of which running, stopping, and conveyance distance are controllable. The driving source is controlled by the control unit (not shown).

A shifting mechanism illustrated in FIG. 2 performs shifting of the sheet ejecting roller 205.

The shifting mechanism includes a shift link 206, a shift cam 207, a shift cam stud 208, and a shift home-position (HP) sensor 209.

Referring to FIG. 2, the shift link 206 arranged on a shaft end of the sheet ejecting roller 205 receives a moving force for the shifting.

The shift cam 207 that includes the shift cam stud 208 is a rotating disc-like component. As the shift cam 207 rotates, the sheet ejecting roller 205, which is movably inserted via the shift cam stud 208 into a shift-link elongated hole 206*a*, is displaced in a direction (hereinafter, also referred to as "sheet width direction") perpendicular to the sheet conveying direction.

This movement is referred to as the shifting. The shift cam stud 208 ganged with the shift-link elongated hole 206*a* has a function of converting the rotational movement of the shift cam 207 into a linear movement in the axial direction of the sheet ejecting roller 205. The shift HP sensor 209 detects a position of the shift link 206. The position detected by the shift HP sensor 209 is assumed as a home position, with reference to which rotation of the shift cam 207 is to be controlled. This control is executed by the control unit.

Referring to FIG. 2, the binding tool 210 corresponding to the deep-nested embossing mechanism (hereinafter, "binding tool 210") includes a sheet-end detection sensor 220, a binding-tool HP sensor 221, and a guide rail 230 for moving the binding tool.

The binding tool 210 is a binding unit, which is referred to as a stapler, for binding a stack of sheets (sheet stack) PB.

In the embodiment, the binding tool 210 has a function of binding sheets together by pinching and pressing sheets between a pair of toothed jaw units (hereinafter, also referred to as "toothed jaws") 261 to deform the sheets, thereby entangling fibers in the sheets. This kind of binding is also referred to as crimp fastening.

Handheld staplers utilizing a binding tool of another binding method are also known. Examples of the other binding method include half-blanking, cut-and-fold, and a method of cutting a portion of sheets and folding the cut portion through a cut opening.

Any one of the handheld staplers contributes resources saving greatly because they reduce consumable consumption, facilitate recycling, and allow the bound sheets to be put into a shredder without a trouble of removing staples. Accordingly, there is a need for sheet processing apparatuses, or finishers, to be equipped with a stapler capable of consumable-less binding, such as crimp fastening, that does not use a metal staple.

Known examples of such a handheld stapler that performs crimp fastening are disclosed as follows:

(1) Japanese Examined Utility Model Application Publication No. S36-13206 discloses a binding tool; and (2) Japanese Examined Utility Model Application Publication No. S37-7208 discloses a binding tool as a handheld stapler that binds sheets by cutting a portion of the sheets and folding the cut portion through a cut opening.

The sheet-end detection sensor 220 detects a side end of a sheet. Sheet alignment is performed with reference to this position detected by the sheet-end detection sensor 220. The binding-tool HP sensor 221 is a sensor that detects a position of the binding tool 210 that is movable in the sheet width direction. A position where, even when a sheet is of maximum size is conveyed, the binding tool 210 does not interfere with the sheet is set as a home position. The binding-tool HP sensor 221 detects this home position.

The guide rail 230 guides movement of the binding tool 210 so that the binding tool 210 can move in the sheet width direction stably.

The guide rail 230 is arranged in such a manner that allows the binding tool 210 to move from the home position across a full width perpendicularly to the sheet conveying direction, in which a sheet is conveyed along the conveying path 240 of the sheet processing apparatus 201.

The binding tool 210 is moved by a moving mechanism including a driving motor (not shown) along the guide rail 230. A sheet passage space is provided on the side of the binding-tool HP sensor 221 of the binding tool 210 so that the binding tool 210 that is moving will not interfere with a sheet P or the sheet stack PB.

Referring to FIG. 3, the conveying path 240 is a conveying pathway for conveying a received sheet and ejecting the sheet. The conveying path 240 extends through the sheet processing apparatus 201 from its entrance to its exit.

The branch path 241 is a conveying path, onto which a sheet is to be conveyed backward in a trailing-end-first manner. The branch path 241 branches off from the conveying path 240. The branch path 241 is provided to overlay sheets conveyed thereonto on one another and align the sheets, and functions as an accumulating unit. An abutment surface 242 provided on a distal end of the branch path 241 is a reference surface, against which the trailing end of the sheet is to be aligned by being brought into contact therewith.

The toothed jaws 261 of the embodiment are a pair of pressing and pinching members having ridge-and-groove shapes that are to mesh together. The toothed jaws 261 provide the crimp fastening function described above by pinching and pressing a sheet stack therebetween.

Figure 4:
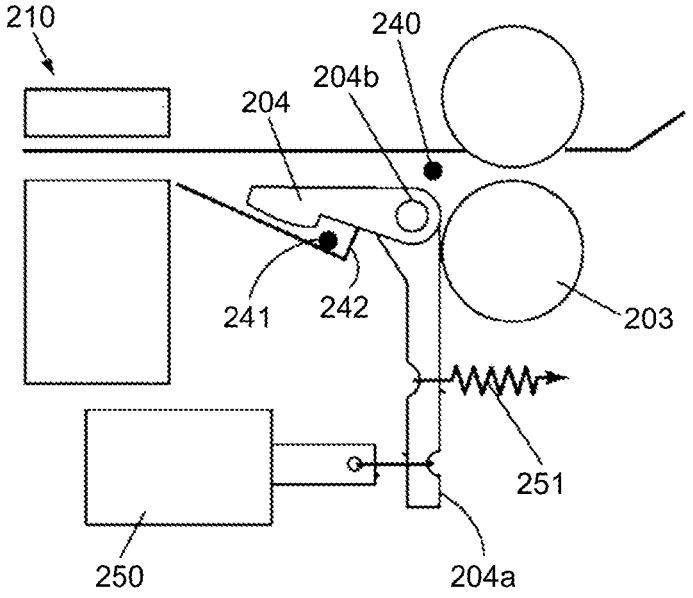
FIG. 4 is a diagram illustrating a bifurcating claw illustrated in FIG. 3 and its relevant mechanism of the sheet processing apparatus in a state where the bifurcating claw is oriented for forward sheet conveyance.
Figure 5:
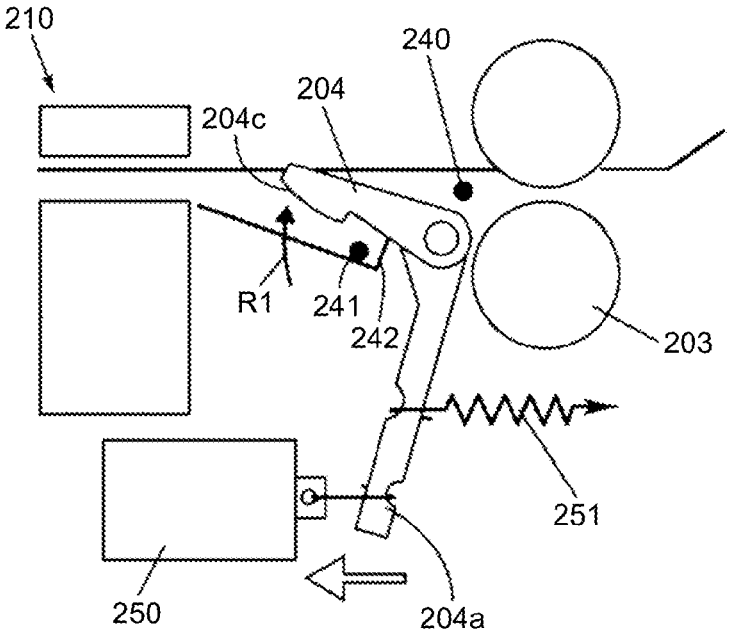
FIG. 5 is a diagram illustrating the bifurcating claw illustrated in FIG. 3 and its relevant mechanism of the sheet processing apparatus in a state where the bifurcating claw is oriented for backward sheet conveyance.

FIGS. 4 and 5 are diagrams illustrating the bifurcating claw 204 and its relevant mechanism of the sheet processing apparatus 201. FIG. 4 illustrates the relevant mechanism in a state where the bifurcating claw 204 is oriented for forward sheet conveyance. FIG. 5 illustrates the relevant mechanism in a state where the bifurcating claw 204 is oriented for backward sheet conveyance.

Referring to FIG. 4, the bifurcating claw 204 is configured to be operable to swing about a support shaft 204*b* within a preset angular range to switch a sheet conveying pathway between the conveying path 240 and the branch path 241. A home position of the bifurcating claw 204 is the position illustrated in FIG. 4 at which a sheet received from a right side in FIGS. 4 and 5 can be conveyed downstream smoothly. A spring 251 constantly applies an urging force counterclockwise in FIGS. 4 and 5 to the bifurcating claw 204.

The spring 251 is hooked onto a bifurcating claw lever 204*a*. A plunger of a path-switching solenoid 250 is connected to the bifurcating claw lever 204*a*. Meanwhile, the branch-path 241 and the bifurcating claw 204 are in the state illustrated in FIG. 5 when a sheet is conveyed onto the branch path 241. Thereafter, when put in the state illustrated in FIG. 4, the surface of the branch path 241 and the bifurcating claw 204 can hold the sheet on the branch conveying path 241 in a pinching state.

Switching of the conveying pathway is performed as follows. When the path-switching solenoid 250 is switched on, the bifurcating claw 204 rotates in a direction indicated by arrow R1 in FIG. 5 to close the conveying path 240 and open the branch path 241, thereby guiding a sheet to the branch path 241.

Figure 6:
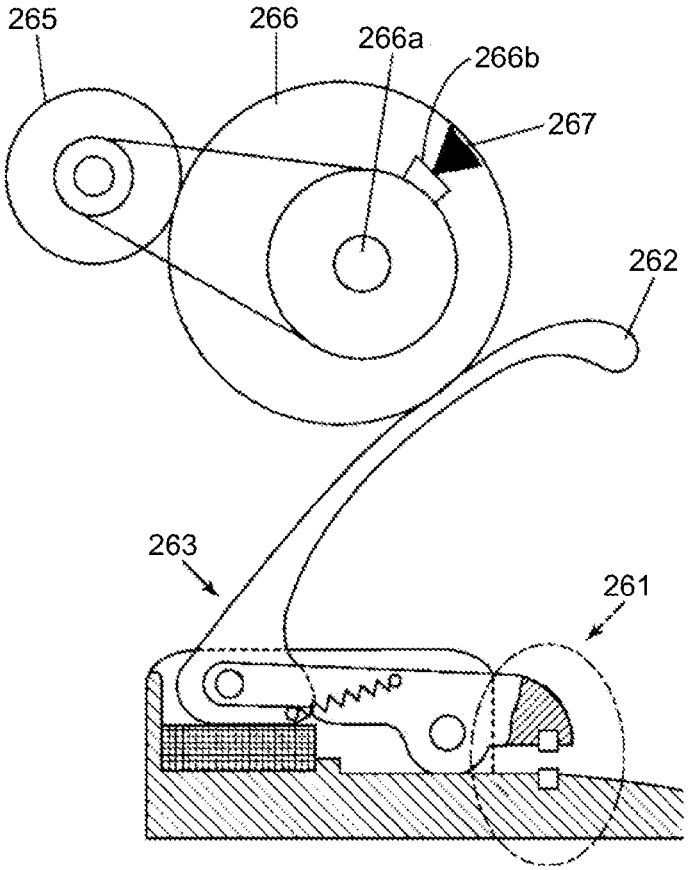
FIG. 6 is a diagram illustrating a binding tool in a not-binding state.
Figure 7:
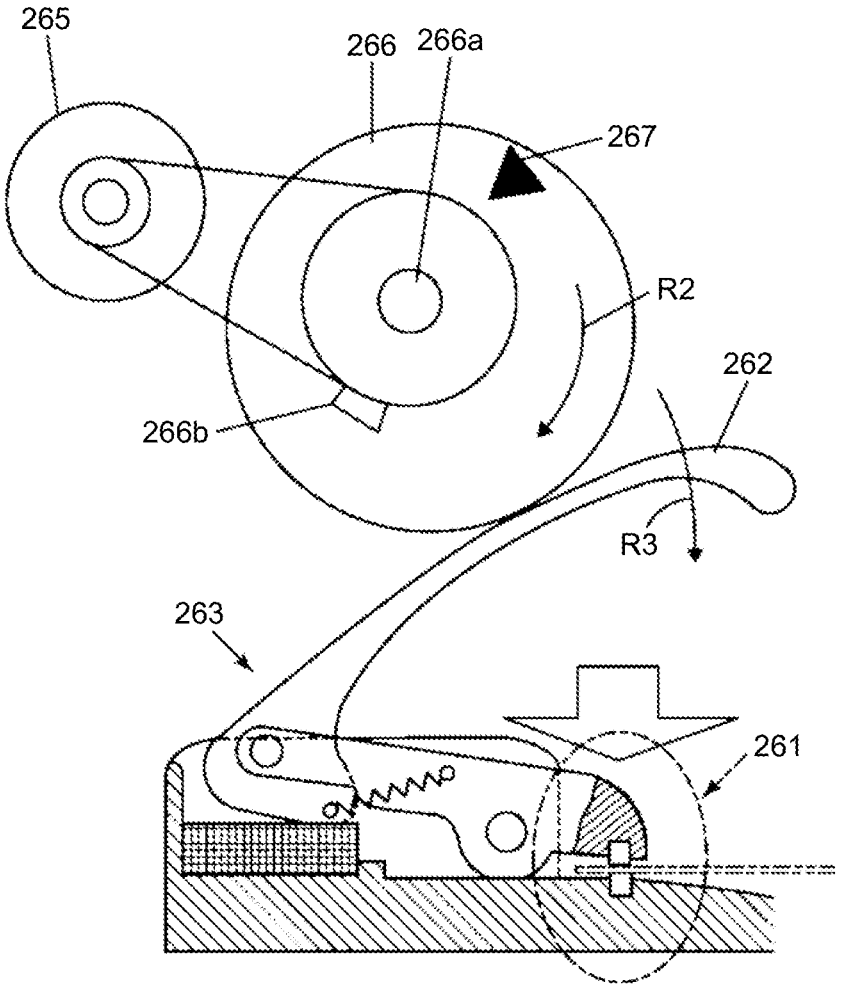
FIG. 7 is a diagram illustrating the binding tool illustrated in FIG. 6 in a binding state.
Figure 8:
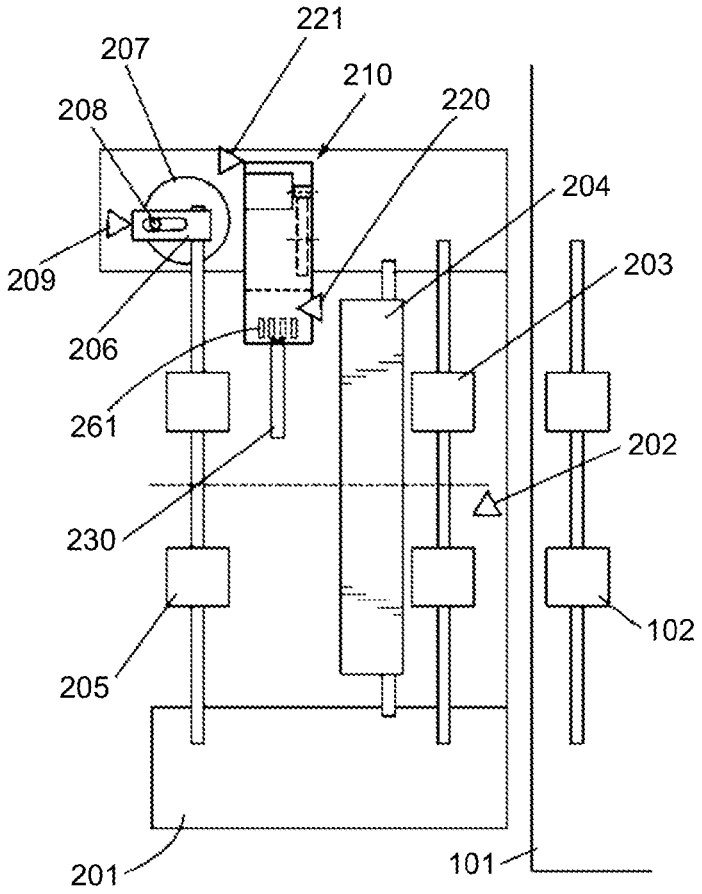
FIGS. 8(A) and 8(B) are operation illustrations depicting a state where initialization of the sheet processing apparatus for online binding is completed.
Figure 8:
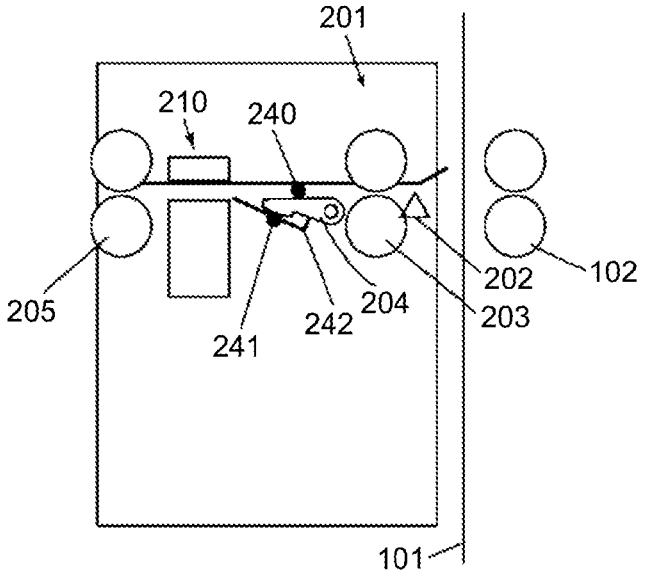
Figure 9:
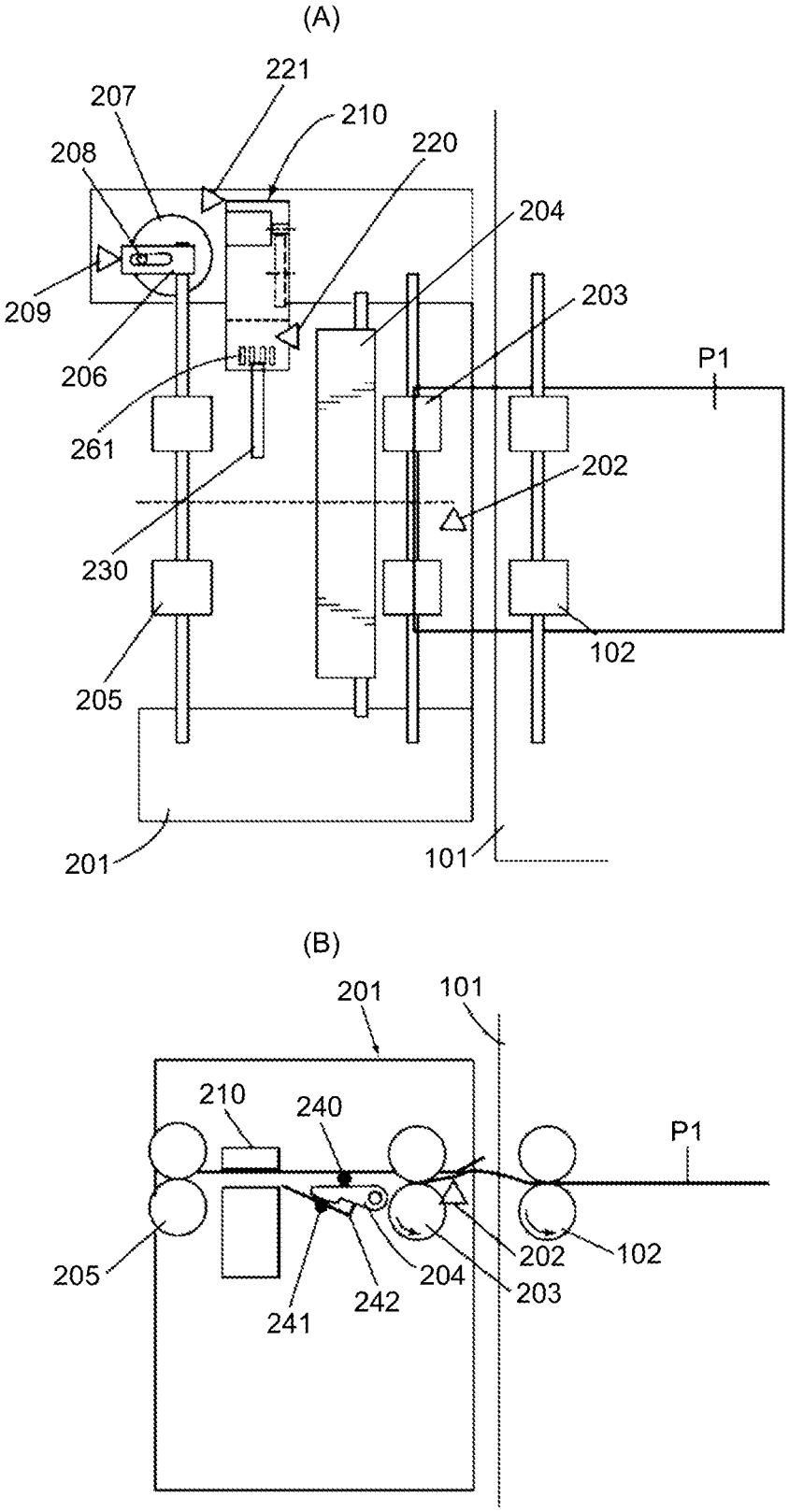
FIGS. 9(A) and 9(B) are operation illustrations depicting a state, which follows the state illustrated in FIGS. 8(A) and 8(B), immediately after when a first sheet is ejected from an image forming apparatus and conveyed into the sheet processing apparatus.

FIGS. 6 and 7 are diagrams illustrating the binding tool 210 according to the embodiment in detail. The binding tool 210 includes the toothed jaws 261 that includes a fixed toothed jaw and a movable toothed jaw, which is movable toward and away from the fixed toothed jaw. The toothed jaws 261 are capable of producing grooves and ridges in a portion of a sheet stack by pressing and deforming the sheet stack. The binding tool 210 includes, as its constituents, not only the toothed jaws 261 but also a pressing lever 262, a link group 263, a driving motor 265, an eccentric cam 266, and a cam HP sensor 267.

The toothed jaws 261 are a pair of an upper pressing member and a lower pressing member shaped so as to mesh with each other. The toothed jaws 261 are located at a motion-receiving end of the link group 263, which is a combination of plurality of links. A pressure-applying motion or a pressure-releasing motion of the pressing lever 262, which is at the other, motion-transmitting end, moves the toothed jaws 261 toward or away from each other.

The pressing lever 262 is pivoted by rotation of the eccentric cam 266. The eccentric cam 266 is rotated by driving force supplied by the driving motor 265. A rotational position of the cam is controlled based on detection data output from the cam HP sensor 267.

The rotational position determines a distance between a rotating shaft 266*a* of the eccentric cam 266 and the surface of the cam. The distance, through which the pressing lever 262 is to be pivoted to apply a pressure, depends on this distance.

A home position of the eccentric cam 266 is a position where the cam HP sensor 267 detects a feeler 266*b*, which is a detection target on the eccentric cam 266. As illustrated in FIG. 6, when the rotational position of the eccentric cam 266 is at the home position, the toothed jaws 261 are in an open state. In this state, binding cannot be performed, and a sheet stack can be received.

Binding a sheet stack is performed as follows. As illustrated by an ellipse in FIG. 6, a sheet stack is inserted between the fixed toothed jaw and the movable toothed jaw, which is movable toward or away from the movable toothed jaw, of the toothed jaws 261 that are in the open state. The driving motor 265 is then rotated. When the driving motor 265 starts rotating, the eccentric cam 266 is rotated in a direction indicated by arrow R2 in FIG. 7. As the eccentric cam 266 rotates in this manner, the cam surface of the eccentric cam 266 is displaced, causing the pressing lever 262 to pivot in a direction indicated by arrow R3 in FIG. 7. This pivoting force is multiplied via the link group 263 that utilizes the principle of levers, and transmitted to the toothed jaws 261 at the motion-receiving end.

When the eccentric cam 266 has rotated a constant amount, the upper and lower toothed jaws 261 are engaged each other to pinch and press the sheet stack. By this pressing, the sheet stack is deformed, fibers of both the neighbor sheets are tangled, and thereby the sheets in stacked state are bound.

Thereafter, the driving motor 265 is rotated in reverse and stopped according to the detection data output from the cam HP sensor 267. Accordingly, the upper and lower toothed jaws 261 return to the state illustrated in FIG. 6 where the sheet stack is movable. The lever 262 is resilient so as to be deformed when an excessive pressure is applied to the lever 262, thereby relieving the excessive pressure.

FIGS. 8 to 16 are operation illustrations depicting a binding operation in online binding performed by the binding tool 210 of the sheet processing apparatus 201. In each of FIGS. 8 to 16, a figure (A) is illustrating a plan view. A figure (B) is illustrating a front view. The online binding in the embodiment denotes binding performed in the following manner. As illustrated in FIG. 1, the sheet processing apparatus 201 is mounted at a sheet ejecting port of the image forming apparatus 101. Sheets, on which images are formed by the image forming apparatus 101, are successively received, aligned, and bound by the sheet processing apparatus 201.

In contrast, manual binding, which will be described later, binds printout sheets produced by the image forming apparatus 101 or other means using the binding tool 210 of the sheet processing apparatus 201. Because the manual binding is not performed as a part of an operation sequence that starts from sheet ejection from the image forming apparatus 101, the manual binding includes offline binding.

FIGS. 8(A) and 8(B) are diagrams illustrating a state where initialization for the online binding is completed. When the image forming apparatus 101 starts producing a printout on which an image is formed, related units move to their home positions, and the initialization is completed. FIGS. 8(A) and 8(B) illustrate this state.

FIGS. 9(A) and 9(B) are diagrams illustrating a state immediately after when a first sheet P1 is ejected from the image forming apparatus 101 and conveyed into the sheet processing apparatus 201.

The control unit (not shown) of the sheet processing apparatus 201 receives mode information about a control mode of sheet processing and sheet information from a control unit (not shown) of the image forming apparatus 101 before the sheet P1 is conveyed from the image forming apparatus 101 into the sheet processing apparatus 201. The sheet processing apparatus 201 enters a receive-ready state based on the information. The sheet information includes, for instance, a sheet size, a sheet type, a paper thickness, and the number of sheets (to be bound) of a booklet.

Three modes, which are a straight mode, a shift mode, and a binding mode, are provided as the control mode. In the straight mode, the entry roller 203 and the sheet ejecting roller 205 in the receive-ready state start rotating in the sheet conveying direction. Sheets P1, P2, . . . , and Pn are successively conveyed and ejected. When the last sheet Pn has been ejected, the entry roller 203 and the sheet ejecting roller 205 are stopped. Meanwhile, n is a positive integer greater than one.

In the shift mode, the entry roller 203 and the sheet ejecting roller 205 in the receive-standby state start rotating in the conveying direction. Shifting and ejecting operations are performed as follows. When the sheet P1 received and conveyed to a point where a trailing end of the sheet P1 leaves the nip of the entry roller 203, the shift cam 207 is rotated a fixed degree. As a result, the sheet ejecting roller 205 is moved in its axial direction. At this time, the sheet P1 is moved together with the sheet ejecting roller 205 that is moved. When the sheet P1 has been ejected, the shift cam 207 rotates to return to its home position to be ready for receiving the next sheet P2. This shifting operation of the sheet ejecting roller 205 is repeatedly performed until the last sheet Pn of the same booklet has been ejected. As a result, the sheet stack PB for the single bundle (the single booklet) is ejected and stacked in a state of being shifted to one side. When the first sheet P1 of a next booklet is conveyed into the sheet processing apparatus 201, the shift cam 207 rotates in a direction opposite to the direction of the previous booklet. Accordingly, the sheet P1 is shifted to a side opposite to the side, to which the previous booklet is shifted, and ejected.

In the binding mode, the entry roller 203 is at rest in the receive-ready state, and the sheet ejecting roller 205 starts rotating in the conveying direction. The binding tool 210 moves to a standby position withdrawn a preset distance from the sheet-end along the sheet-width direction and enters a standby state.

In this mode, the entry roller 203 also functions as a registration roller. More specifically, when the first sheet P1 is conveyed into the sheet processing apparatus 201 and the leading end of the sheet P1 is detected by the entry sensor 202, the leading end of the sheet P1 is brought into contact with the nip of the entry roller 203.

The sheet P1 is conveyed by the sheet ejecting rollers 102 of the image forming apparatus 101*a* distance that causes the sheet P1 to be resiliently bent a preset amount. After the sheet P1 has been conveyed the distance, the entry roller 203 starts rotating. Skew of the sheet P1 is corrected in this manner. FIGS. 9(A) and 9(B) illustrate this state.

FIGS. 10(A) and 10(B) are diagrams illustrating a state where the trailing end of the sheet has left the nip of the entry roller 203 and passed over the branch path 241.

The conveyance distance of the sheet P1 is calculated from the detection data output from the entry sensor 202 on detection of the trailing end of the sheet P1. A controller (not shown) keeps track of position data of the position of the sheet being conveyed. When the trailing end of the sheet has passed through the nip of the entry roller 203, the entry roller 203 stops rotating to receive the next sheet P2. Concurrent therewith, the shift cam 207 rotates in a direction indicated by arrow R4 in FIG. 10A (clockwise shown in FIG. 10(A)), causing the sheet ejecting roller 205, which is nipping the sheet P1, to start moving in the axial direction. As a result, the sheet P1 is conveyed obliquely in a direction indicated by arrowed line D1 shown in FIG. 10(A). Thereafter, when the sheet-end detection sensor 220 attached to or built in the binding tool 210 detects the sheet P1, the shift cam 207 stops rotating, and then rotates in reverse. When the sheet-end detection sensor 220 does not detect the sheet P1 any more, the shift cam 207 stops rotating. When the operations described above are completed and the trailing end of the sheet reaches a predetermined position where the trailing end has passed over a distal end of the bifurcating claw 204, the sheet ejecting roller 205 is stopped.

FIGS. 11(A) and 11(B) are diagrams illustrating a state where the sheet P1 is conveyed backward so that the sheet P1 is aligned in the conveying direction.

After the bifurcating claw 204 is pivoted in a direction indicated by arrowed line R5 in FIG. 11(B) to switch the conveying pathway to the branch path 241, the sheet ejecting roller 205 is rotated in reverse. As a result, the sheet P1 is conveyed backward in a direction indicated by arrowed line D2 in FIG. 11(A), whereby the trailing end of the sheet P1 is conveyed into the branch path 241, and further conveyed into contact with the abutment surface 242.

The trailing end of the sheet is aligned against the abutment surface 242 by being brought into contact therewith. When the sheet P1 has been aligned, the sheet ejecting roller 205 is stopped. The sheet ejecting roller 205 is configured to rotate at idle so as not to apply a conveying force to the sheet P1 when the sheet P1 is in contact with the abutment surface 242. More specifically, the sheet ejecting roller 205 is configured so as to prevent buckling of the sheet that can occur if the sheet is further conveyed after the sheet is conveyed backward into contact with the abutment surface 242 and the trailing end of the sheet is aligned against the abutment surface 242.

FIGS. 12(A) and 12(B) are diagrams illustrating a state where the first sheet P1 is held on the branch path 241 and the second sheet P2 is being conveyed into the sheet processing apparatus 201.

After the preceding, first sheet P1 has been aligned against the abutment surface 242, the bifurcating claw 204 is pivoted in a direction indicated by arrowed line R6 in FIG. 12(B). As a result, a contact surface 204*c*, which is a bottom surface of the bifurcating claw 204, tightly presses down the trailing end of the sheet P1 on the branch path 241 against a surface of the branch path 241 to hold the sheet P1 still. In this state, the bifurcating claw 204 is put on standby. When the following, second sheet P2 is conveyed from the image forming apparatus 101, the entry roller 203 performs skew correction on the sheet P2 as in the case of the preceding sheet P1. Subsequently, concurrently when the entry roller 203 starts rotating, the sheet ejecting roller 205 starts rotating in the conveying direction.

FIGS. 13(A) and 13(B) are diagrams illustrating a state where the second sheet P2 has been conveyed into the sheet processing apparatus 201.

Figure 10:
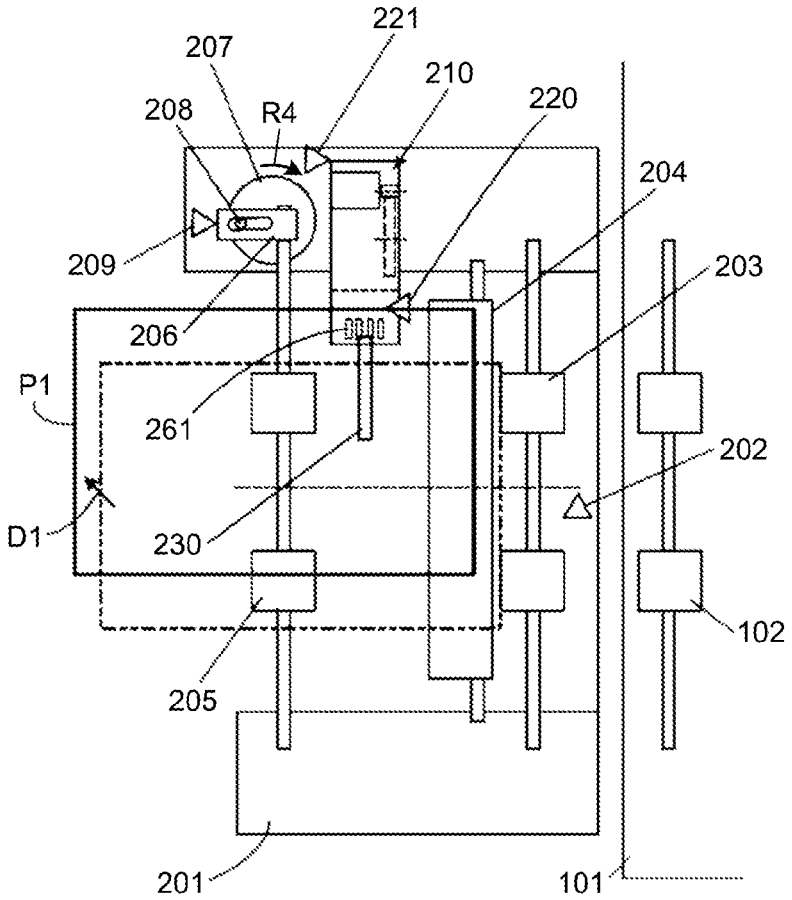
FIGS. 10(A) and 10(B) are operation illustrations depicting a state, which follows the state illustrated in FIGS. 9(A) and 9(B), where a trailing end of the sheet has left a nip of entry rollers and passed over a branch path.
Figure 10:
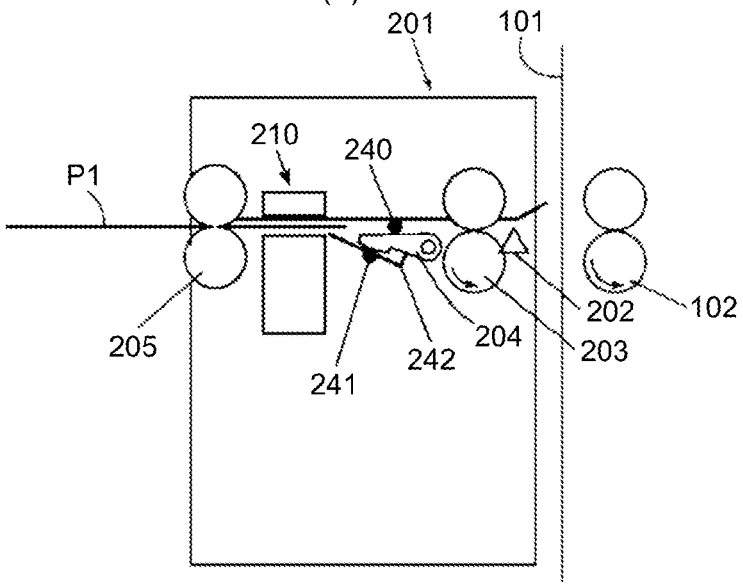
Figure 11:
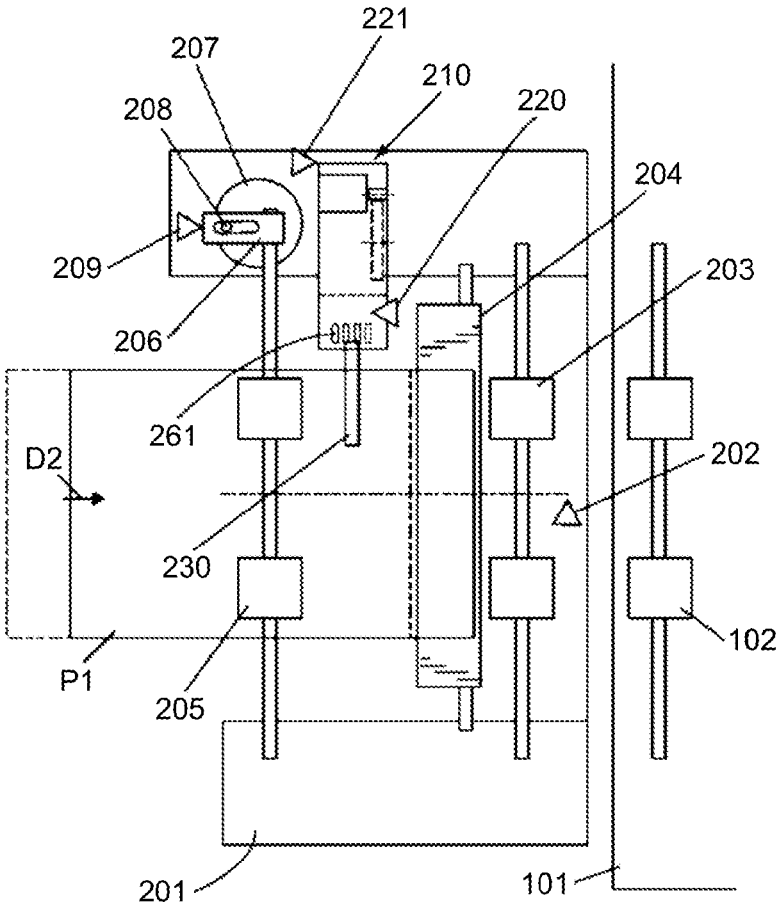
FIGS. 11(A) and 11(B) are operation illustrations depicting a state, which follows the state illustrated in FIGS. 10(A) and 10(B), where the sheet is conveyed backward to align the sheet in a sheet conveying direction.
Figure 11:
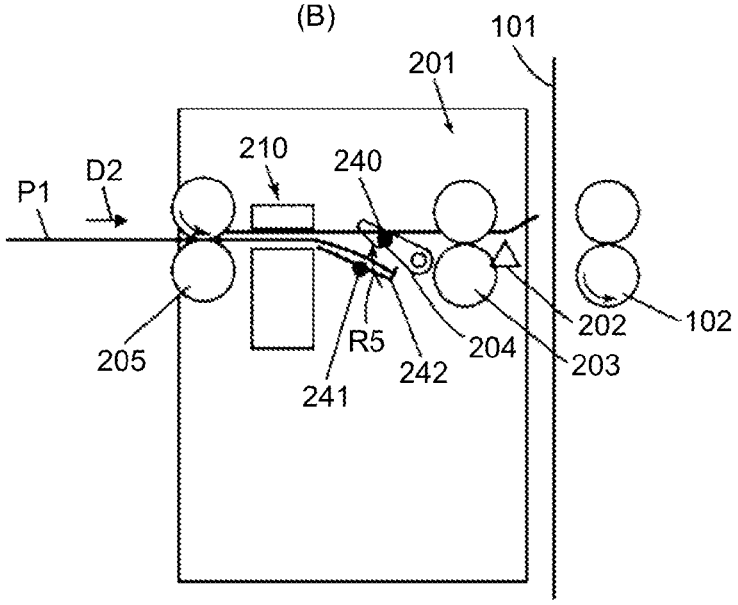
Figure 12:
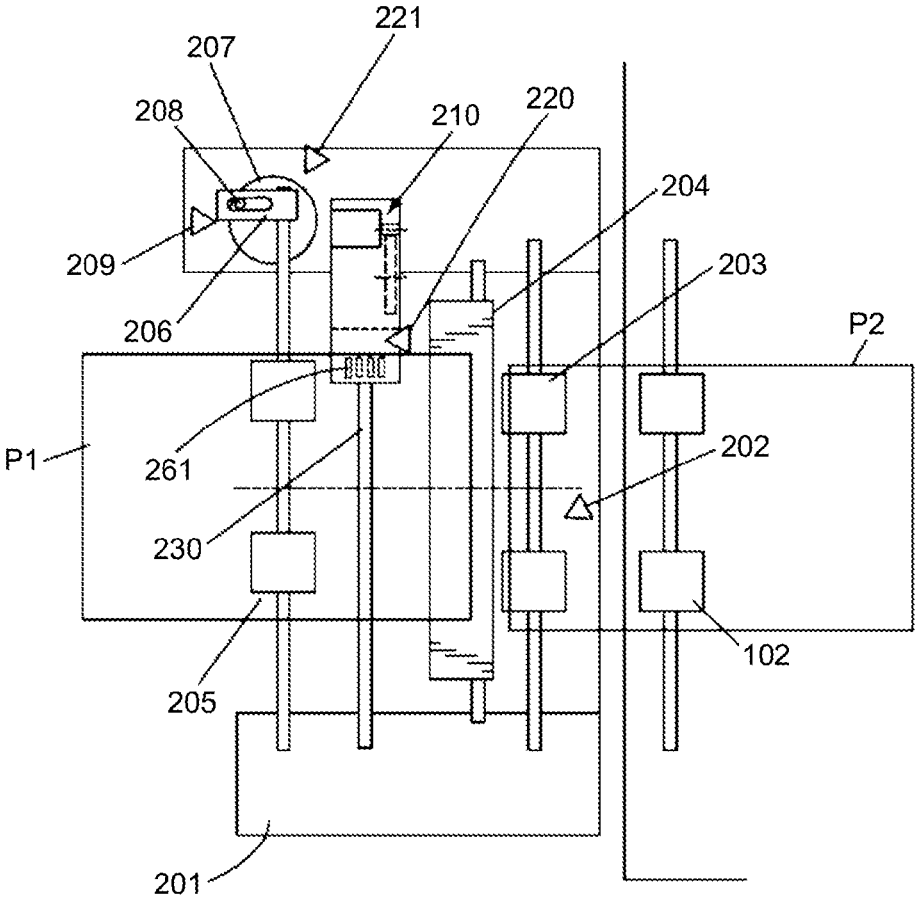
FIGS. 12(A) and 12(B) are operation illustrations depicting a state, which follows the state illustrated in FIGS. 11(A) and 11(B), where the first sheet is held on the branch path and a next, second sheet is being conveyed into the sheet processing apparatus.
Figure 12:
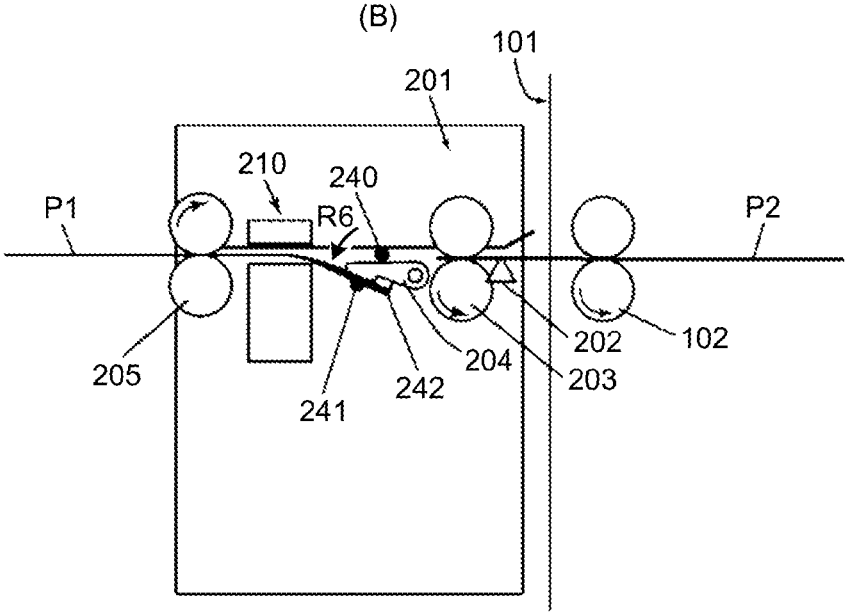
Figure 13:
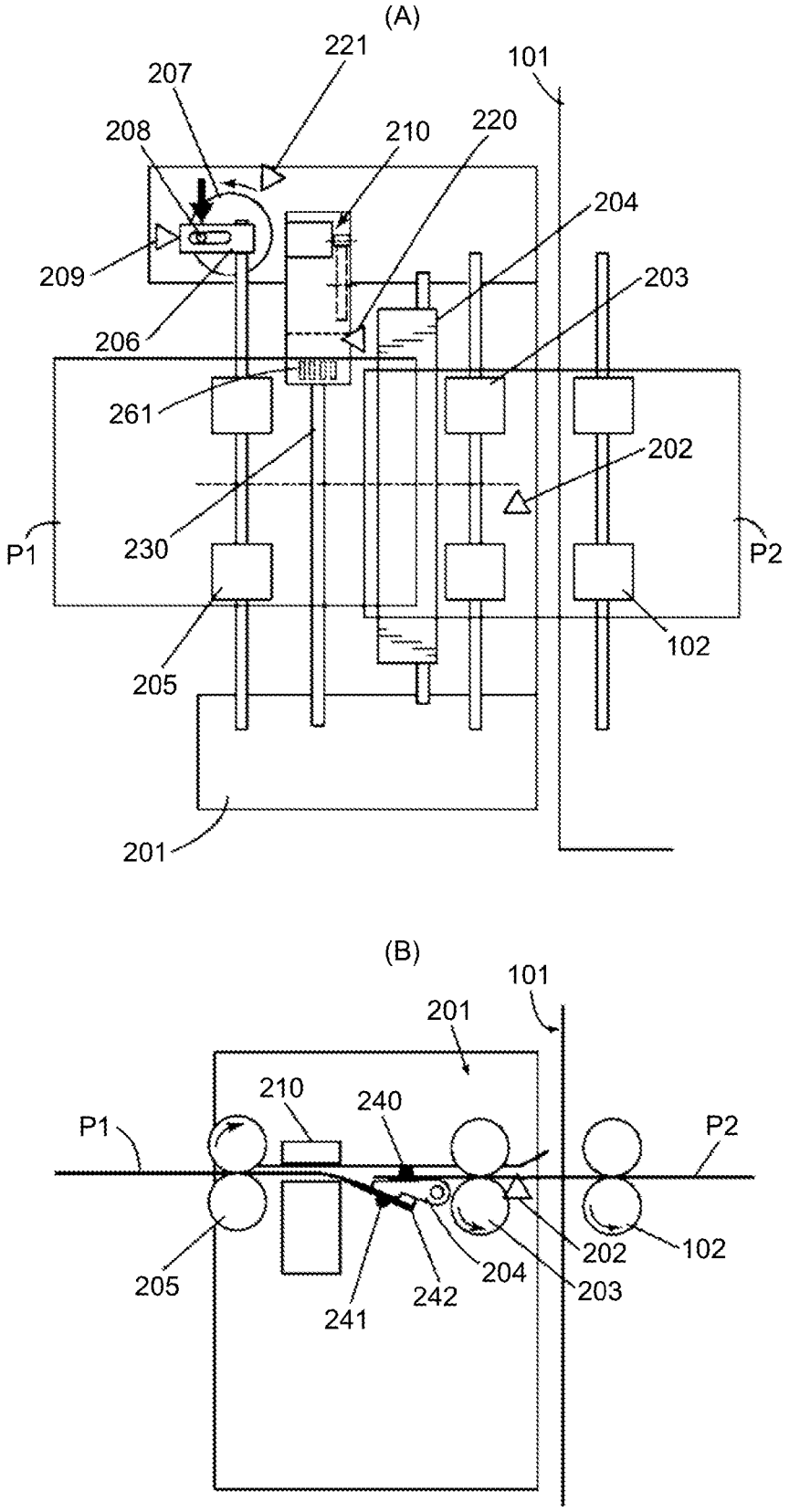
FIGS. 13(A) and 13(B) are operation illustrations depicting a state, which follows the state illustrated in FIGS. 12(A) and 12(B), where the second sheet has been conveyed into the sheet processing apparatus.

Each time when one of the second sheet P2, and third and following sheets P3, . . . , and Pn is conveyed from the state shown in FIG. 12, the operations illustrated in FIGS. 10 and 11 are performed. The sheets conveyed from the image forming apparatus 101 are successively moved to the preset position and overlaid on one another. The sheet stack PB that is aligned is stacked (accumulated) on the conveying path 241.

FIGS. 14(A) and 14(B) are diagrams illustrating a state where the last sheet Pn is aligned and the sheet stack PB is formed.

Referring to FIGS. 14(A) and 14(B), when forming the aligned sheet stack PB is completed by aligning the last sheet Pn, the sheet ejecting roller 205 is rotated a certain amount in the conveying direction and then stopped. This operation straightens the sheet(s) that is resiliently bent when the trailing end of the sheet is brought into contact with the abutment surface 242. Thereafter, the bifurcating claw 204 is pivoted in the direction indicated by arrowed line R5 in FIG. 14(B) to separate the contact surface 204*c* from the branch path 241, thereby releasing the pressing force applied to the sheet stack PB. As a result, the sheet stack PB is released from a restraint force applied by the bifurcating claw 204, allowing the sheet stack PB to be conveyed by the sheet ejecting roller 205.

FIGS. 15(A) and 15(B) are diagrams illustrating a state where a binding operation is performed.

Figure 14:
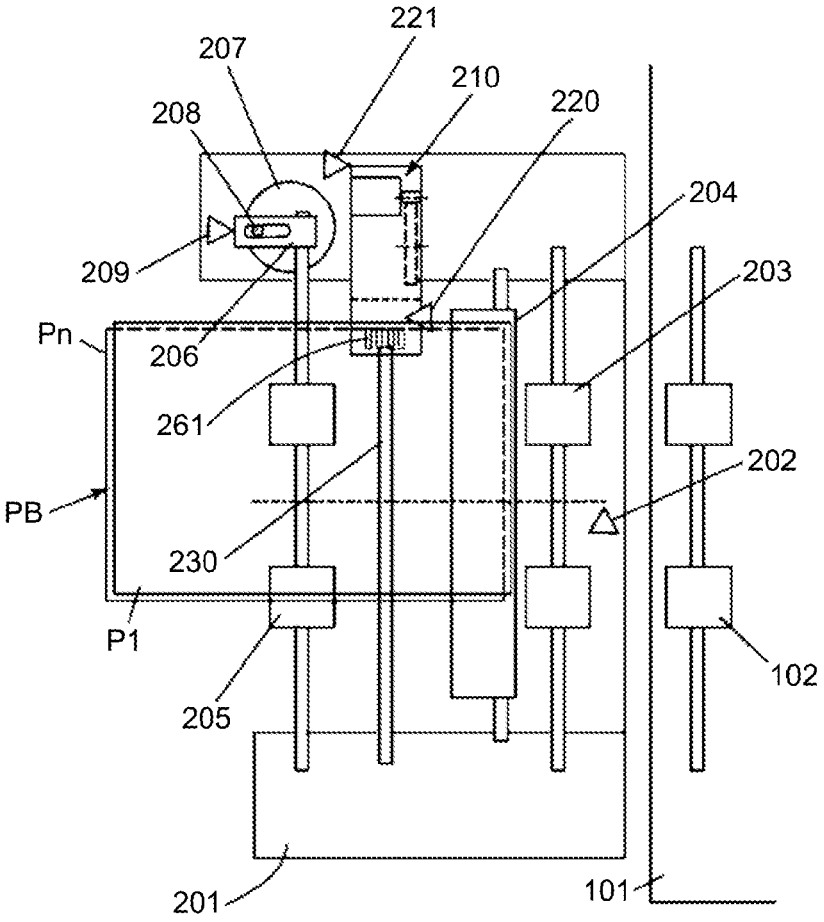
FIGS. 14(A) and 14(B) are operation illustrations depicting a state, which follows the state illustrated in FIGS. 13(A) and 13(B), where a last (final) sheet is aligned and a sheet stack is formed.
Figure 14:
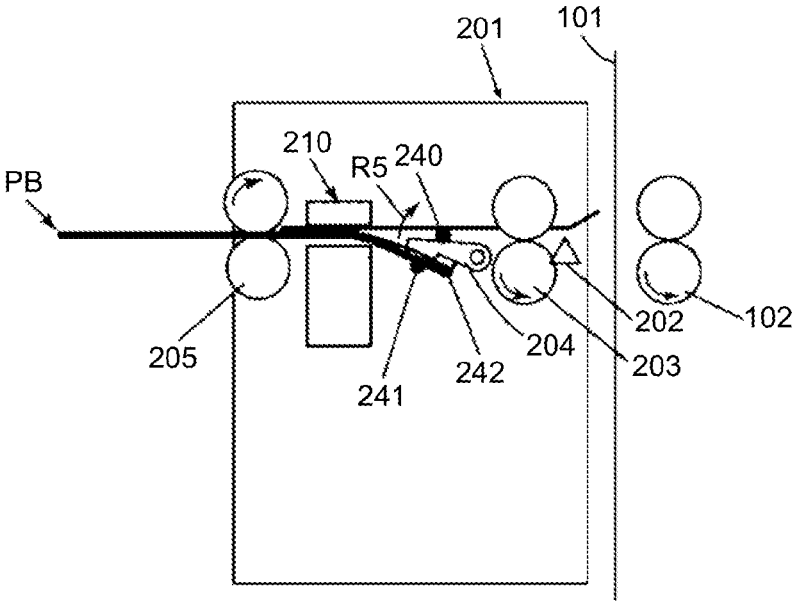

The sheet ejecting roller 205 is rotated in the conveying direction from the state illustrated in FIG. 14 to convey the sheet stack PB a distance that brings the sheet stack PB to a position where the position of the toothed jaws 261 of the binding tool 210 coincides with a binding position of the sheet stack PB. The sheet ejecting roller 205 is stopped when the sheet stack PB has reached this position. Consequently, the position where the sheet stack PB is to be processed in the conveying direction coincides with the position of the toothed jaws 261 in the conveying direction. The binding tool 210 is moved in a direction indicated by arrowed line D3 in FIG. 15(A) a distance that brings the binding tool 210 to a position where the position of the toothed jaws 261 of the binding tool 210 coincides with the position where the sheets are to be processed, and stopped. Consequently, the position where the sheet stack PB is to processed coincides with the position of the toothed jaws 261 both in the conveying direction and in the width direction. At this time, the bifurcating claw 204 pivots in the direction indicated by arrowed line R6 in FIG. 15(B) to return to the sheet-receiving state. Thereafter, crimp fastening is performed by switching on the binding-tool driving motor 265 to cause the toothed jaws 261 to press and crimp the sheet stack PB therebetween. In the embodiment, an example that employs the binding tool 210 that performs crimp fastening is described. However, as a matter of course, a binding tool of another binding method, such as half-blanking, cut-and-fold, and a method of cutting a portion of sheets and folding the cut portion through a cut opening, can be employed.

FIGS. 16(A) and 16(B) are diagrams illustrating a state where the sheet stack PB is ejected.

Figure 15:
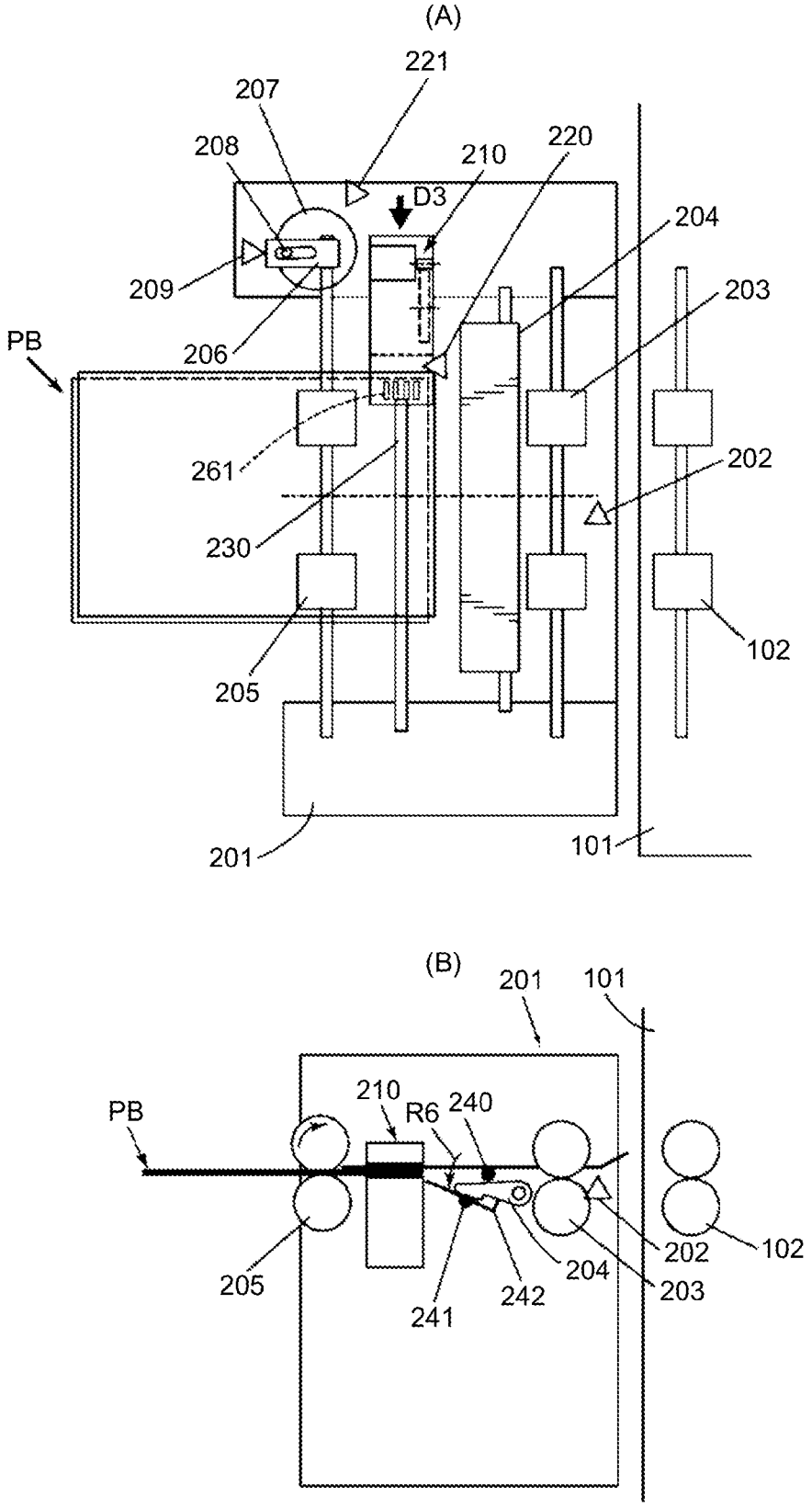
FIGS. 15(A) and 15(B) are operation illustrations depicting a state, which follows the state illustrated in FIG. 14, where binding is performed.
Figure 16:
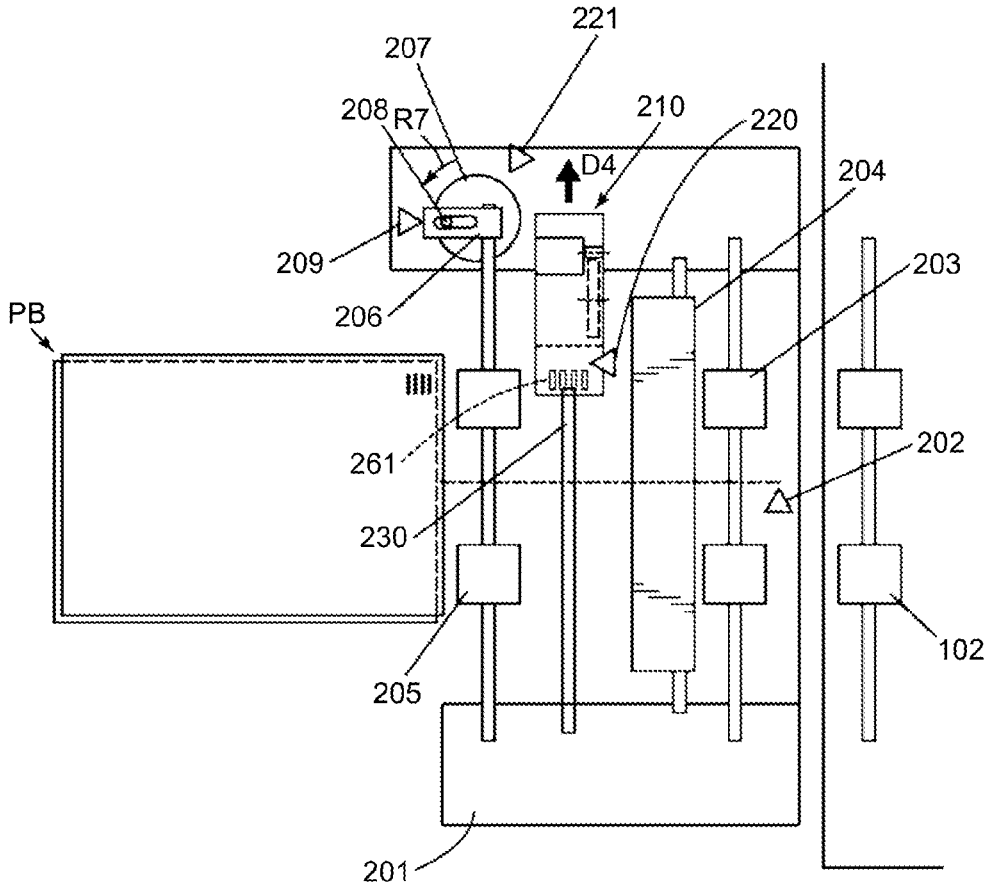
FIGS. 16(A) and 16(B) are operation illustrations depicting a state, which follows the state illustrated in FIGS. 15(A) and 15(B), where the sheet stack is ejected.
Figure 16:
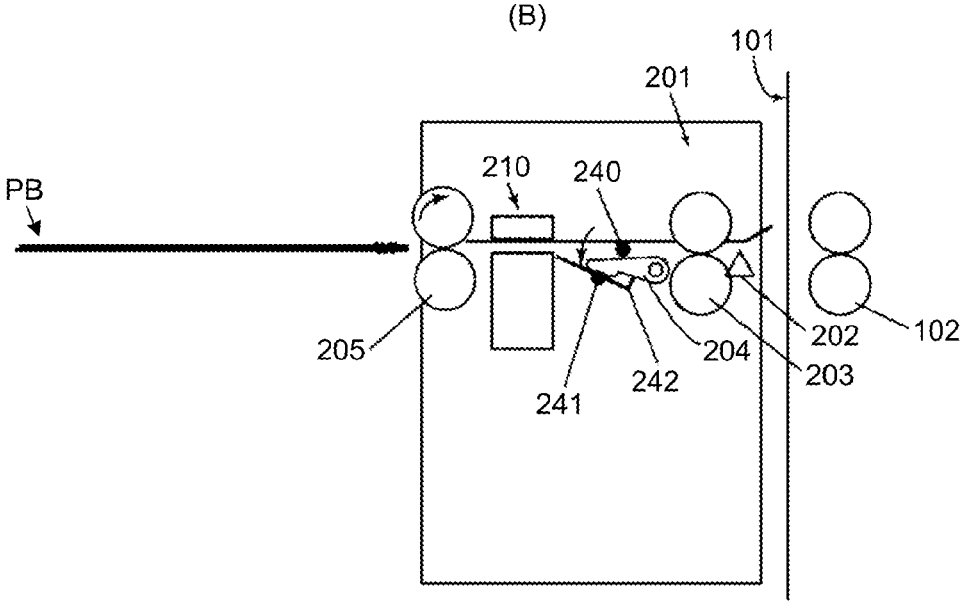

The sheet stack PB bound as illustrated in FIG. 15 is ejected by rotation of the sheet ejecting roller 205. After the sheet stack PB has been ejected, the shift cam 207 is rotated in a direction indicated by arrowed line R7 in FIG. 16(A) to return the shift cam 207 to its home position (the position illustrated in FIG. 8(A)). Simultaneously, the binding tool 210 is moved in a direction indicated by arrowed line D4 in FIG. 16(A) to return the binding tool 210 to its home position (the position illustrated in FIG. 8(A)). At this point, operations for aligning and binding the single bundle (the single booklet) of the sheet stack PB are completed. When a next booklet is to be produced, the operations illustrated in FIGS. 8 to 16 are repeated to produce a crimp-fastened single bundle of the sheet stack PB in a similar manner.

Configuration to implement a feature of the embodiment based on the configuration described above is described below.

Figure 17:
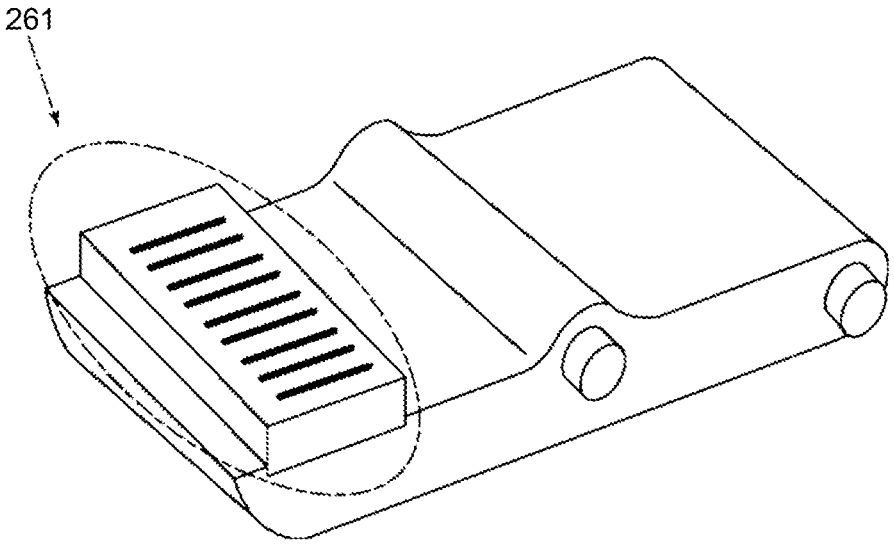
FIG. 17 is a diagram illustrating an exterior view of one of toothed jaws for use in the sheet processing apparatus according to the embodiment.

FIG. 17 is a diagram illustrating the toothed jaw 261 illustrated in FIGS. 6 and 7 as viewed from the bottom side in FIGS. 6 and 7.

Figure 19:
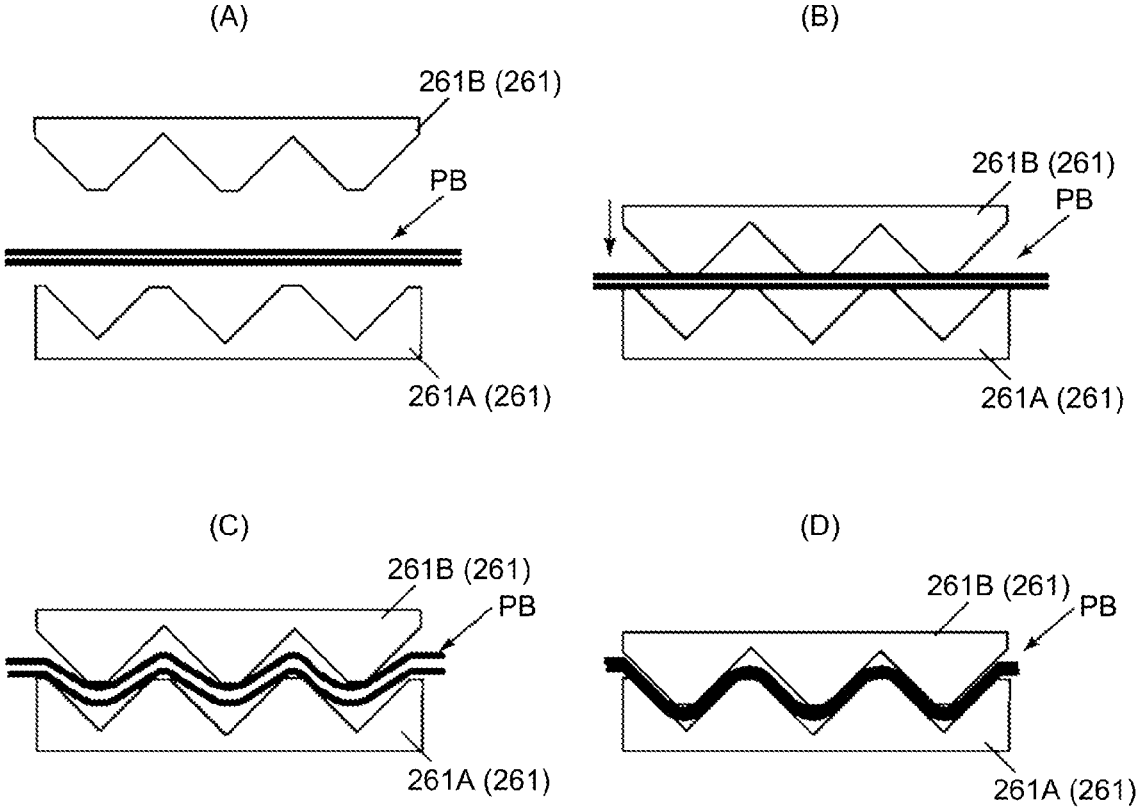
FIGS. 19(A) to 19(D) are diagrams for describing process steps of binding performed by the sheet processing apparatus according to the embodiment.

Referring to FIGS. 17 and 19, a plurality of teeth 261A, each extending in a direction perpendicular to the axial direction of a support shaft serving as a pivot, are formed on the toothed jaw 261 and arranged in the axial direction of the support shaft.

Figure 18:
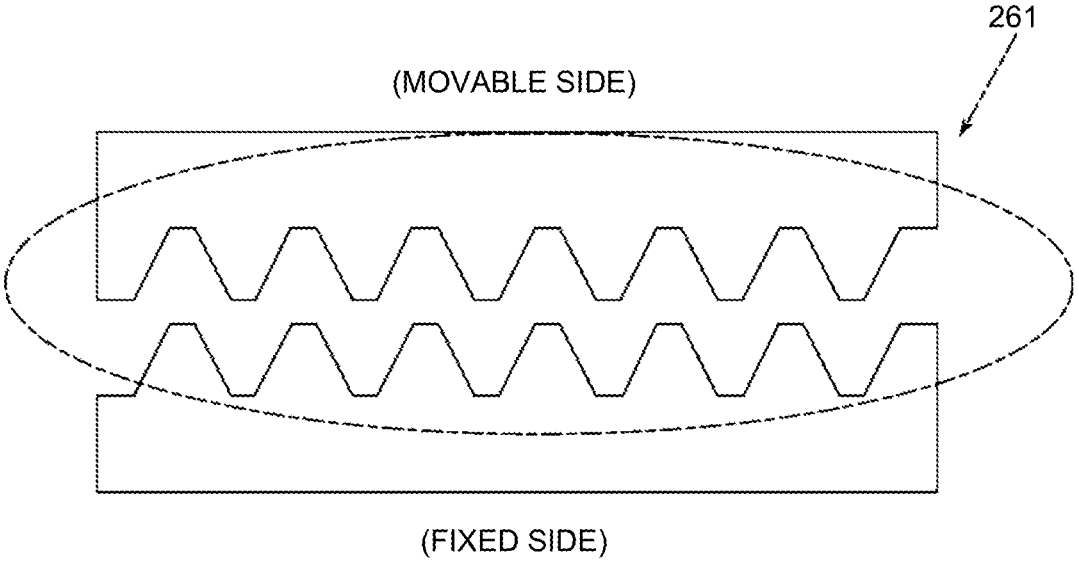
FIG. 18 is a diagram illustrating a side view of the toothed jaw illustrated in FIG. 17 and the other toothed jaw facing each other.

The toothed jaws 261 are configured such that, as illustrated in FIG. 18, top surfaces of the teeth are out of phase between the fixed side and the movable side so that the upper and lower toothed jaws can mesh with each other.

The binding performed using the binding tool 210 serving as the binding unit, is described below.

FIGS. 19(A) to 19(D) are diagrams for describing a crimp fastening method performed on an end binding portion.

Referring to FIG. 19, as shown in FIG. 19(A), the toothed jaws 261 employed in the binding tool 210 include the crimping teeth (the lower teeth 261A and upper teeth 261B) arranged to face each other across the sheet stack PB (see FIGS. 14(A) and 14(B)).

The crimping teeth on one (or both) of the upper and lower sides are moved to apply a force (FIGS. 19(B) to 19(C)).

As the pressing force increases, the sheets are pressed and deformed to be raised and recessed in the shape of the crimping teeth, and the binding is completed (FIG. 19(D)).

Engagement of raised portions (grooves) and recessed portions (ridges) and tangling and fixing of fibers in the sheets make this crimp fastening possible. The ridge-and-groove shape of the crimping teeth 261A, 261B has slopes inclined at arbitrary angle.

Crests and valleys of the ridge-and-groove shape differ from each other in geometry so that, for instance, top lands of the upper crimping teeth 261B do not contact valley portions of the lower crimping teeth 261A (this not-contacted state is not shown) when the crimping teeth 261A and 261B are in mesh. This shape causes the sheet stack PB to be crimped using only the slopes, making effective binding possible.

Figure 20:
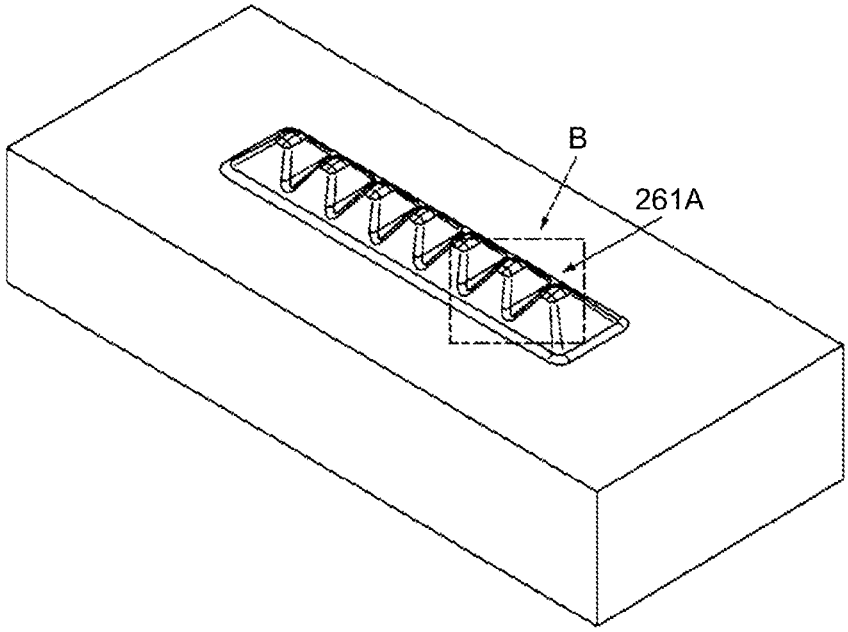
FIGS. 20(A) and (B) are diagrams showing exterior view for describing features of the toothed jaw illustrated in FIG. 17.
Figure 20:
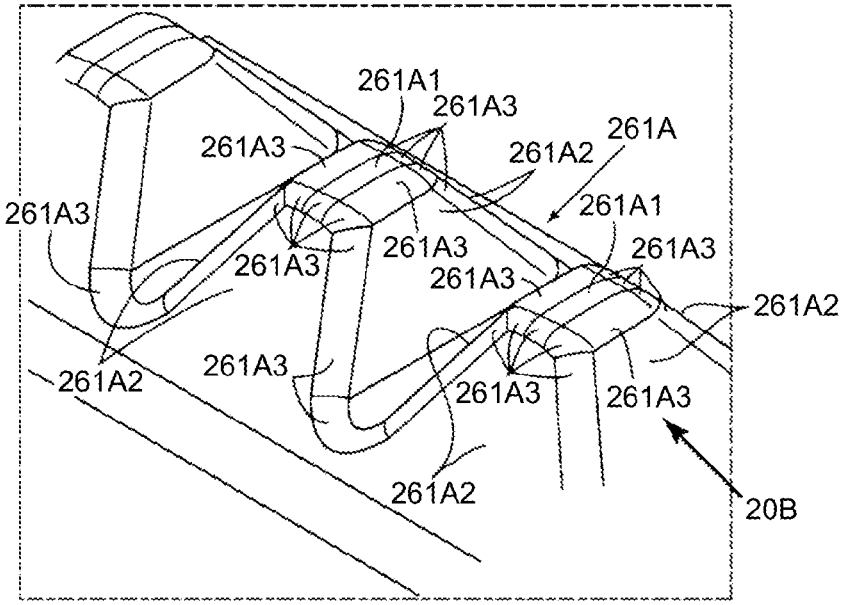

FIGS. 20(A) and 20(B) are diagrams illustrating the feature of the embodiment.

Referring to FIGS. 20A and 20B, each of the fixed toothed jaw and the movable toothed jaw (FIGS. 20(A) and 20(B) illustrate the teeth 261A of the fixed toothed jaw) is formed such that at least one portion of edges is rounded as illustrated in FIG. 20(B).

In the configuration illustrated in FIG. 20(B), the tooth 261A includes a substantially-horizontal top land 261A1 and curved surfaces 261A2 extending from the top land 261A1. Edges, or ridgelines 261A3, between the top land 261A1 and the curved surfaces 261A2 are rounded rather than edged.

In the configuration illustrated in FIG. 20B, the top land 261A1 extending from the curved surfaces 261A2 is also rounded. Ridgelines 261A3 between the four sides of the top land 261A1 and the curved surfaces 261A2 are also rounded.

Figure 21:
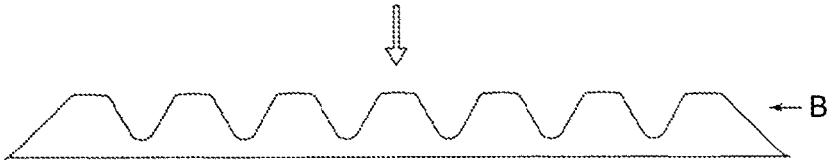
FIGS. 21(A) and 21(B) are diagrams for building a configuration of the toothed jaw illustrated in FIG. 17.
Figure 21:
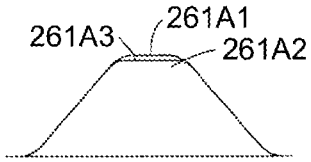

FIG. 21(A) is a diagram of the toothed jaw 261 as viewed from a direction perpendicular to a direction, along which the teeth of the toothed jaw 261 are arranged. Referring to FIG. 21(A), the cross section taken perpendicularly to the direction (direction indicated by open arrow), in which the toothed jaws are brought into mesh, is rounded. FIG. 21(B) is an enlarged view of a region indicated by arrowed line B in FIG. 21(A) and corresponds to a view taken along arrowed line 20B in FIG. 20(B).

As illustrated in FIG. 21(B), the top land 261A1 is rounded such that the top land 261A1 gradually projects from the ridgelines 261A3, which are edges between the top land 261A1 and the curved surfaces 261A2, and projects most at a center portion.

Furthermore, ridgelines between the curved surfaces 261A2 and bottom portions of the toothed jaw, or, in other words, edges between the top portion and the bottom portions, are also rounded.

Adopting such a rounded shape is advantageous as follows. Even when a pressure is concentrated onto areas of the sheets where are located at a side edge portion of the top portion of the toothed jaws, the rounded edge of the top portion disperses the concentrated pressure. As a result, the sheets are prevented from being wrinkled or torn.

Furthermore, even when a pressure concentrates onto areas of the sheets where are located at the edges between the top portion and the bottom portions of the toothed jaws after completion of binding the sheets by pressing them between the toothed jaws, the rounded shape disperses the concentrated pressure. As a result, the sheets are also prevented from being wrinkled or torn.

The rounded ridgeline portions between the faces of the toothed jaws 261 described above can be formed by performing any one of cutting and resin molding using a molding die.

Figure 22:
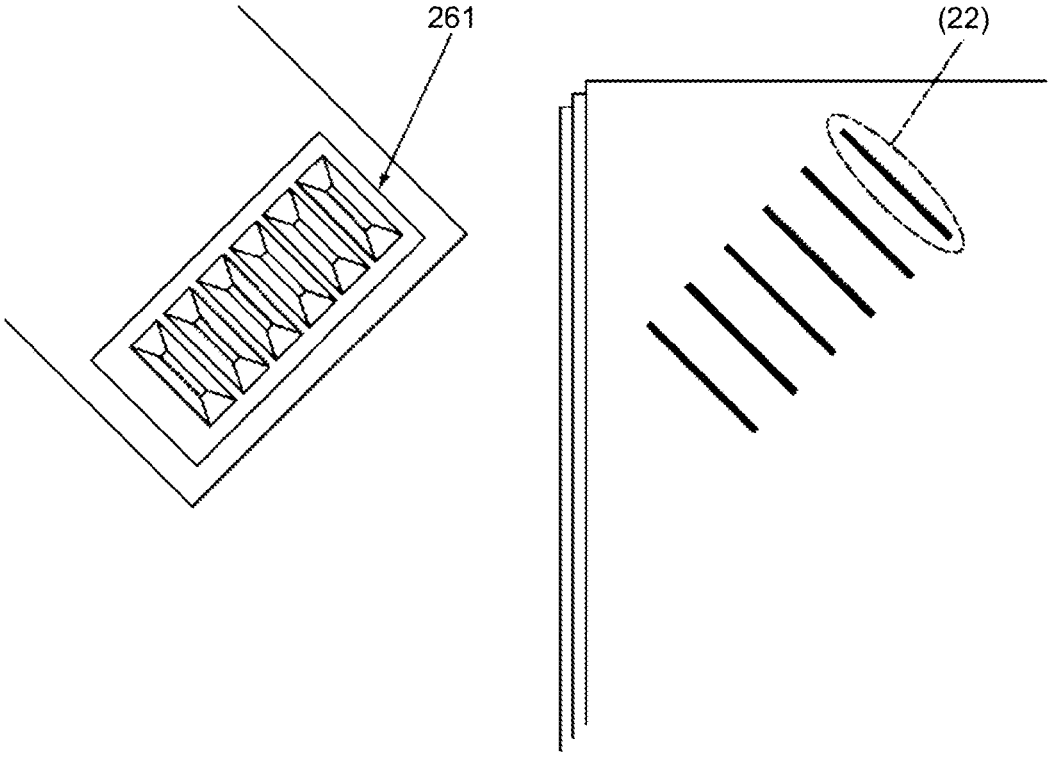
FIG. 22 is a diagram illustrating a sheet stack bound using the toothed jaw illustrated in FIG. 20.

FIG. 22 illustrates a sheet stack bound using the toothed jaws 261 described above.

Figure 23:
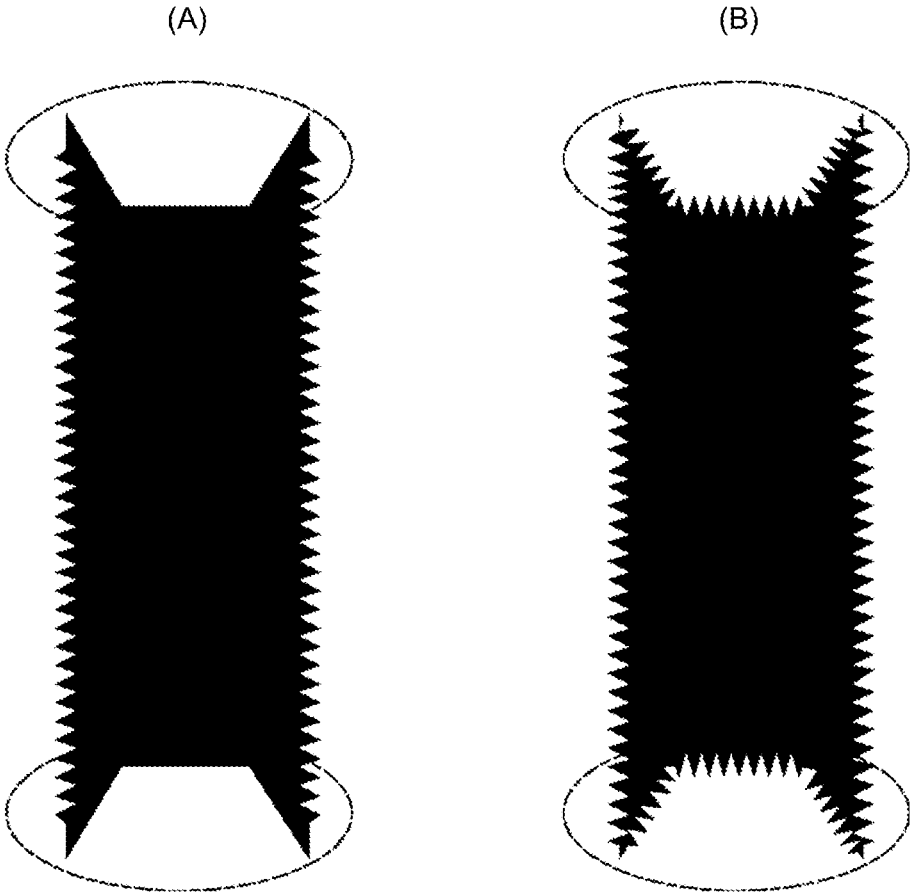
FIGS. 23(A) and 23(B) are diagrams for comparing a state of fibers in sheets bound using conventional toothed jaws to a state of fibers in sheets bound using the toothed jaws of the embodiment.

FIGS. 23(A) and 23(B) are enlarged views each illustrating one (indicated by (22) in FIG. 22) of crimped portions of the sheet stack.

FIG. 23(A) illustrates a crimped portion produced using conventional toothed jaws having edged ridgelines. FIG. 23(B) illustrates a crimped portion produced using the toothed jaws according to the embodiment.

When toothed jaws having such edged ridgelines as illustrated in FIG. 23(A) are used, fibers in the bound sheets are broken. In contrast, as illustrated in FIG. 23(B), when the toothed jaws according to the embodiment are used, fibers in the bound sheets are not broken.

Thus, when the toothed jaws according to the embodiment are used, sheets will not be torn, and fibers are joined together by being pressed during the binding. As a result, the bound portion is strengthened.

Moreover, a relatively large area is pressed and moved by utilizing the top land 261A1, which is the substantially horizontal surface. Accordingly, fiber breakage resulting from load concentration is less likely to occur, in contrast to binding using a sharp-edged top land.

When the toothed jaws according to the embodiment are used, fibers will not be broken, whereby stress against a pressing force applied to perform binding can be increased. As a result, sheets' resiliency to recover to their original shape is lessened, causing the sheets to be maintained in the bound state.

The configuration described above, which can be obtained by simply changing the configuration of the toothed jaws for use in binding, can increase strength of a bound portion. Furthermore, the configuration can lessen sheets' resiliency to recover to their original shape, thereby preventing the sheets from becoming apart.

Modifications of the toothed jaw units are described below.

In the modifications described below, the one or more rounded edges of the toothed jaw unit are used as a damage lessening portion capable preventing sheets from being wrinkled or torn by applying, in addition to rounding as described above, chamfering to the edges.

Figure 24:
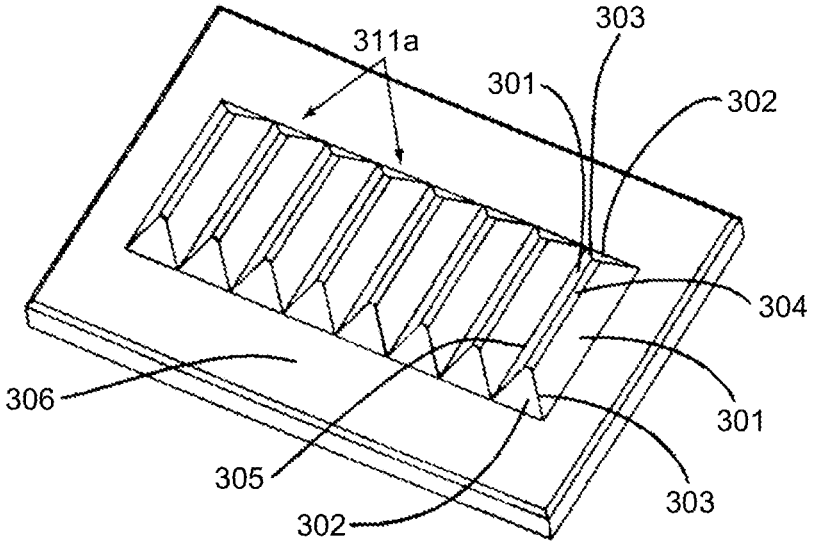
FIG. 24 is a perspective view for describing a first modification, which is another example of the toothed jaw.

FIG. 24 is an enlarged perspective view of the configuration of a lower crimping toothed jaw 311. In the description below, the lower toothed jaw 311 is mainly illustrated and described as the crimping toothed jaw; however, the same applies to an upper toothed jaw 310. Referring to FIG. 24, the lower toothed jaw 311 includes tooth faces 301, side faces 302, sides 303 between a base 306 and distal ends of teeth 311*a* (310*a*), top-land edges 304 of the teeth 311*a* (310*a*), and tooth roots 305 corresponding to bottom portions of the tooth faces. The base 306 is a portion where the tooth roots 305 are combined together.

When the sheet stack PB is pinched between the upper toothed jaw 310 and the toothed jaw 311, the top-land edges 304 of the teeth 310*a* and 311*a* come into contact with the sheet stack PB. When the sheet stack PB is further pinched, the tooth faces 301 are brought into contact with the surface of the sheet stack PB.

Figure 25:
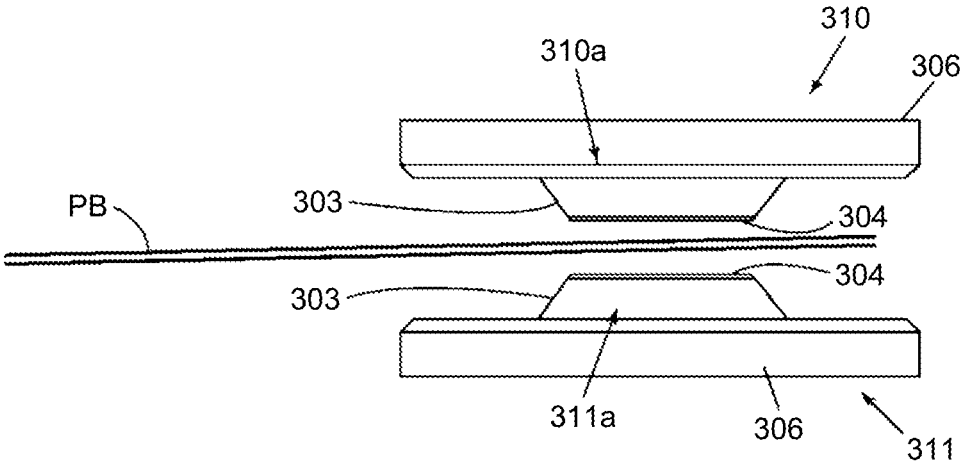
FIG. 25 is a diagram illustrating a sheet stack that is slanted at an end portion of sheets due to heat applied during fixation.

Meanwhile, the sheet stack PB can be slanted at an end portion of the sheet stack PB as illustrated in FIG. 25 due to heat applied during fixation. When the sheet stack PB being pinched is not parallel to an edge 304 of the tooth 311*a*, the top-land edge 304 of the tooth 311*a* makes point contact, rather than line contact, with the sheet stack PB. The sheet stack PB also contacts the side 303 extending between the base 306 and the top-land edge 304, whereby a sheet(s) belonging to the sheet stack PB can be undesirably damaged, torn, or wrinkled. It is difficult to adjust this inclination, and it is inevitable that the sheet stack PB contacts the side 303 extending between the base 306 and the top-land edge 304.

First Modification of Crimping Toothed Jaw

Figure 26:
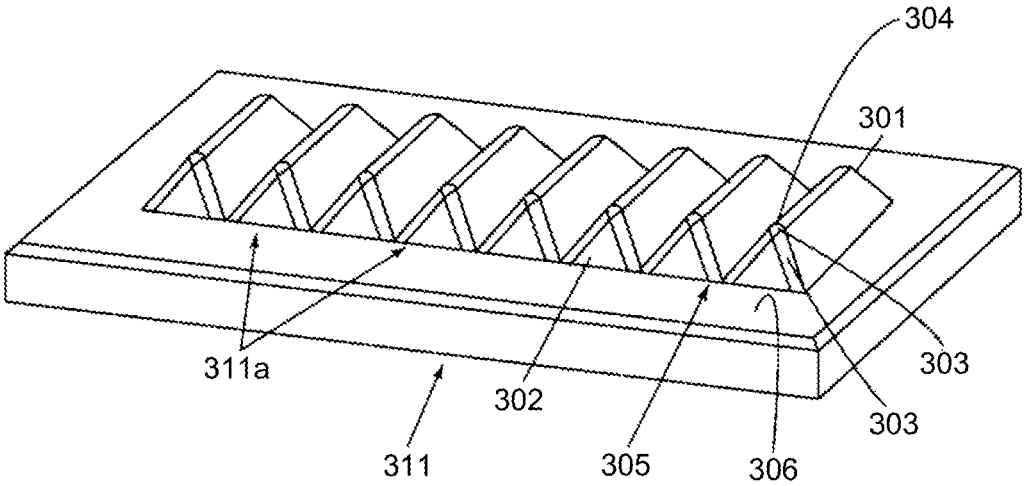
FIG. 26 is a diagram illustrating a first modification of crimping toothed jaw of the binding tool for use in the sheet processing apparatus according to the embodiment.

FIG. 26 is a diagram illustrating a first modification of the crimping toothed jaw. In the lower toothed jaw 311 of the first modification, the sides 303 extending between the base 306 and the top-land edges 304 of the teeth 311*a* and the top-land edges 304 are rounded to serve as the damage lessening portion as illustrated in FIG. 26. This rounding prevents the sheet stack PB that contacts the top-land edges 304 from being damaged or torn. Furthermore, this rounding can also prevent a wrinkle, which can be formed when the sheet stack PB pinched between the upper toothed jaw 310 and the lower toothed jaw 311 is deflected, in the sheet stack PB. Thus, stabilizing a binding force on the sheet stack PB can be achieved.

This is because the sides 303 extending between the base 306 and the top-land edges 304 of the lower toothed jaw 311 are rounded to lessen damage to sheets.

More specifically, a sharp change in pressure from a portion where the sheet stack PB contacts the teeth 310*a* of the upper toothed jaw 310 or the teeth 311*a* of the lower toothed jaw 311 and therefore a large force is applied to the sheet stack PB to a portion where the sheets are not in contact is moderated. Accordingly, the sheets that contact the top-land edges 304 of the teeth 310*a* or 311*a* are prevented from being damaged, torn, or wrinkled. Furthermore, a wrinkle, which can be formed when sheets pinched between the crimping toothed jaws 310 and 311 are deflected, in the sheet stack PB is also prevented.

The toothed jaw may include, as the damage lessening portion, a portion that is chamfered in lieu of the predetermined portion that is rounded. At least one of the sides 303 is preferably configured as the damage lessening portion so that damage to the sheet stack PB to be bound can be lessened. Arrangement and installation form are not limited to those of the embodiment described above and below.

Second Modification of Crimping Toothed Jaw

Figure 27:
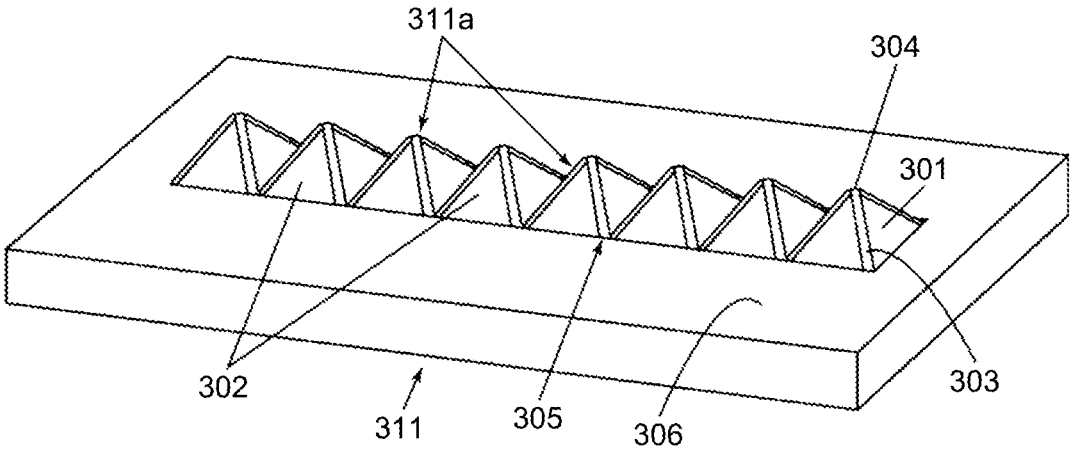
FIG. 27 is a diagram illustrating a second modification of the crimping toothed jaw for use in the sheet processing apparatus according to the embodiment.

FIG. 27 is a diagram illustrating a second modification of the crimping toothed jaw for use in the sheet processing apparatus according to the embodiment. Each teeth 311*a* of the lower toothed jaw 311 of the second modification is pyramidal in shape; however, the lower toothed jaw 311 is identical to that of the first modification in basic configuration including rounding the sides 303 and the top-land edges 304, and the form of the teeth roots 305.

Third Modification of Crimping Toothed Jaw

Figure 28:
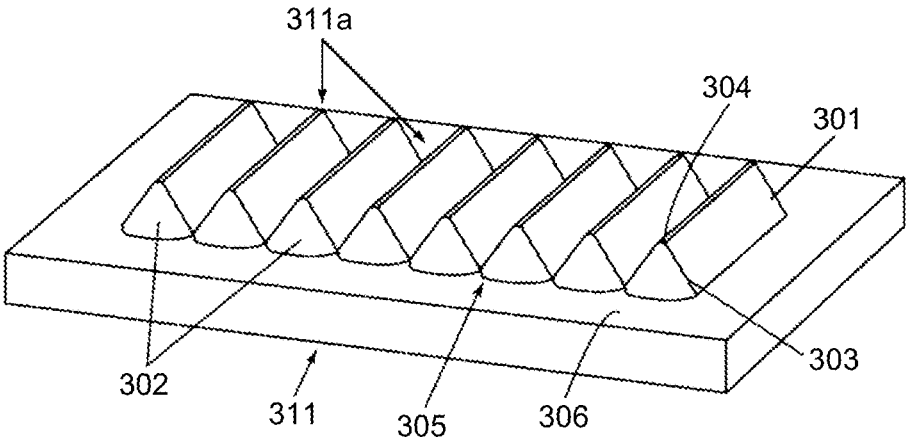
FIG. 28 is a diagram illustrating a third shape example of the crimping toothed jaw for use in the sheet processing apparatus according to the embodiment.

FIG. 28 is a diagram illustrating a third modification of the crimping toothed jaw for use in the sheet processing apparatus according to the embodiment. The side face 302 of Each teeth 311*a* of the lower toothed jaw 311 of the third modification has a shape similar to a vertically-divided half of a cone; however, the lower toothed jaw 311 is identical to that of the first modification in basic configuration including rounding the top-land edges 304 and the form of the teeth roots 305.

Mesh State of Crimping Toothed Jaws

Figure 29:
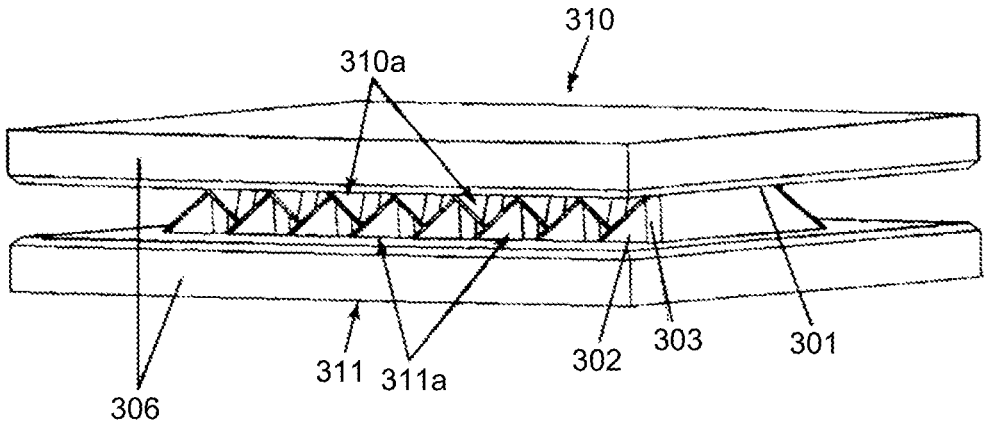
FIG. 29 is a diagram illustrating an upper crimping toothed jaw and a lower crimping toothed jaw, each including teeth configured as illustrated in FIG. 26, that are in mesh.

FIG. 29 is a diagram illustrating the upper toothed jaw 310 and the lower toothed jaw 311, each including the teeth configured as illustrated in FIG. 26, that are in mesh. The pressing force applied from the side 303 extending between the base 306 to the top-land edge 304 of the tooth 310*a*, 311*a* onto the sheet stack PB is large near the top-land edge 304 and small near the base 306.

Effect of Damage Lessening Portion on Binding Process

Figure 30:
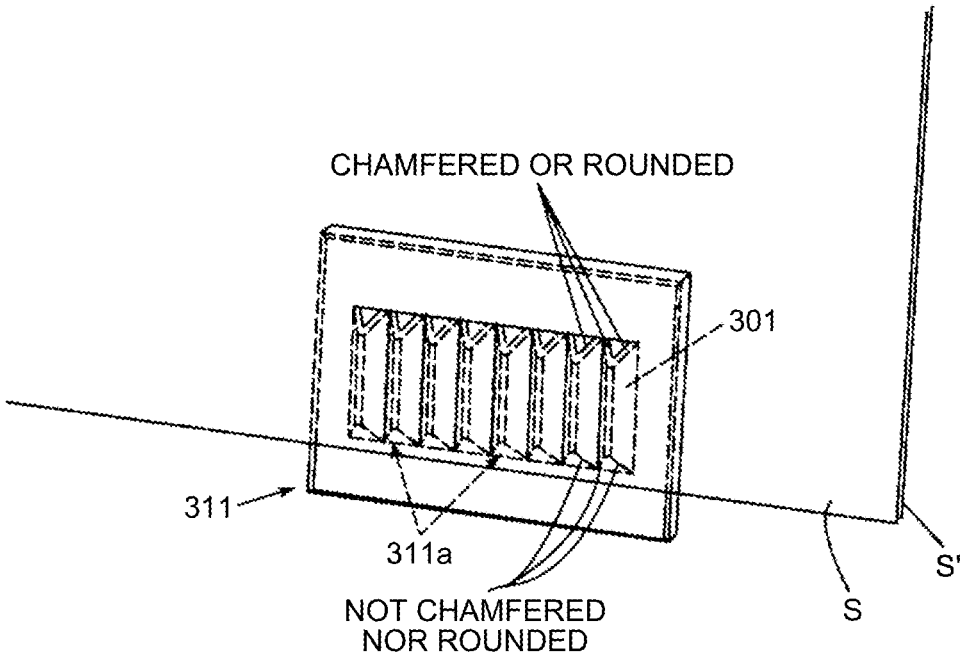
FIG. 30 is a diagram illustrating a form of wrinkles formed in a sheet stack when the crimping toothed jaws configured as illustrated in FIGS. 26 to 29 are used.

As illustrated in FIG. 30, mesh of the upper toothed jaw 310 and the lower toothed jaw 311 produces a ridge-and-groove shape in the bound sheet stack PB. A wrinkle resulting from deflection of a sheet S' contained in the sheet stack PB is formed near the ridge-and-groove shape. When the sheet stack PB is bound near an edge of the sheet S', no wrinkle is formed on the side of the edge, at which no paper is present, of the sheet S' but a wrinkle is produced on the side of the center of the sheet S'. If such situations as illustrated in FIG. 30 are assumed, cost can be reduced by reducing the number of rounding or chamfering processes in a binding process. This is achieved by applying rounding or chamfering only to the sides 303, which extend between the base 306 and the top-land edges 304, on the side where a wrinkle is formed.

Figure 31:
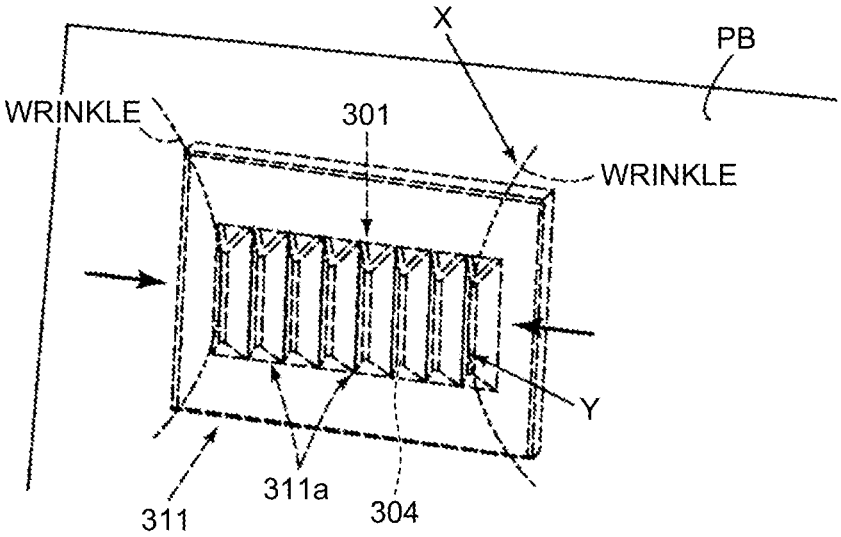
FIG. 31 is a diagram illustrating positions where wrinkles are formed.

FIG. 31 is a diagram illustrating positions where wrinkles are formed.

When the ridge-and-groove shape is formed in the bound sheet stack PB by the binding tool, on which the teeth 311*a* are aligned, the sheet stack PB shrinks in a direction, in which the teeth 311*a* are aligned. An amount of deformation of the sheets increases toward the outermost tooth in the direction, in which the teeth 311*a* are aligned. The larger the deformation amount, the more likely a wrinkle is formed. Deformation of the sheets at the ridge-and-groove portion acts to deform a portion around the ridge-and-groove portion of the sheets. As a result, the wrinkle lengthens in a direction along flank lines (direction in which the top-land edges 304 extends) of the teeth 311*a*. In FIG. 31, Y indicates a wrinkle formed along the flank like; X indicates a wrinkle formed at a portion where no tooth is present.

Other implementation examples of the toothed jaws for use in the binding tool are described below.

Figure 32:
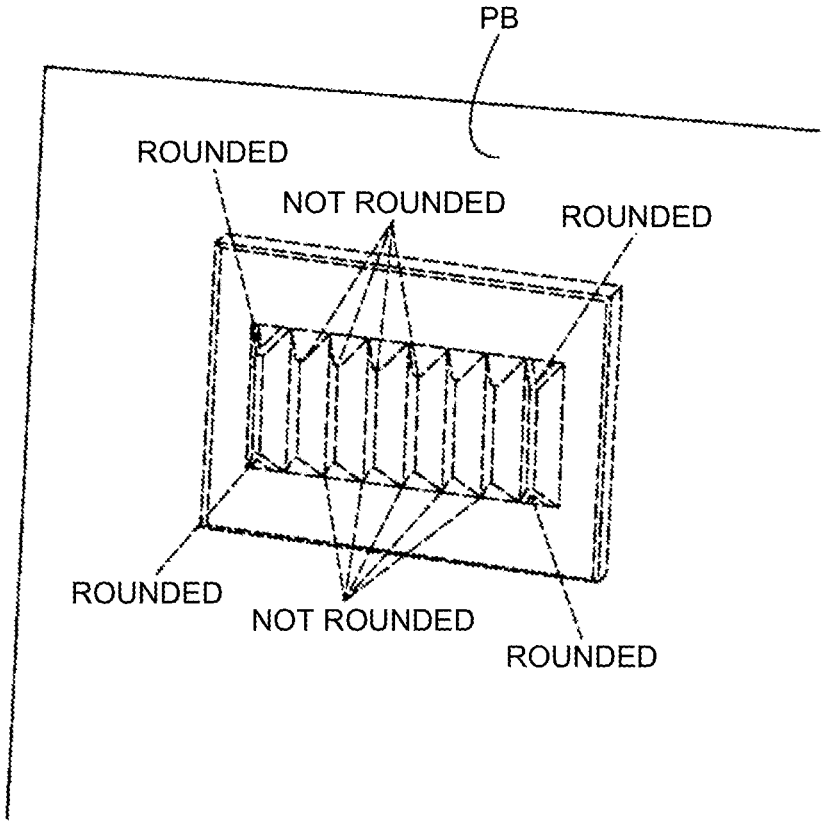
FIG. 32 is a diagram illustrating a modification example of a shape of the crimping toothed jaw of the binding tool for use in the sheet processing apparatus according to the embodiment.

In the example illustrated in FIG. 32, outer teeth (captioned with "ROUNDED" in FIG. 32) each having one of the sides 303, which extend between the base 306 and the top-land edges 304, where a wrinkle is formed are rounded or chamfered but the other inner teeth are not rounded nor chamfered.

As a result, a configuration substantially same as a configuration, in which the edges 304 has no edged portion that causes pressure to concentrate onto sheets, can be obtained while reducing the number of rounding or chamfering processes in processing of the binding tool, whereby cost reduction can be achieved.

Figure 33:
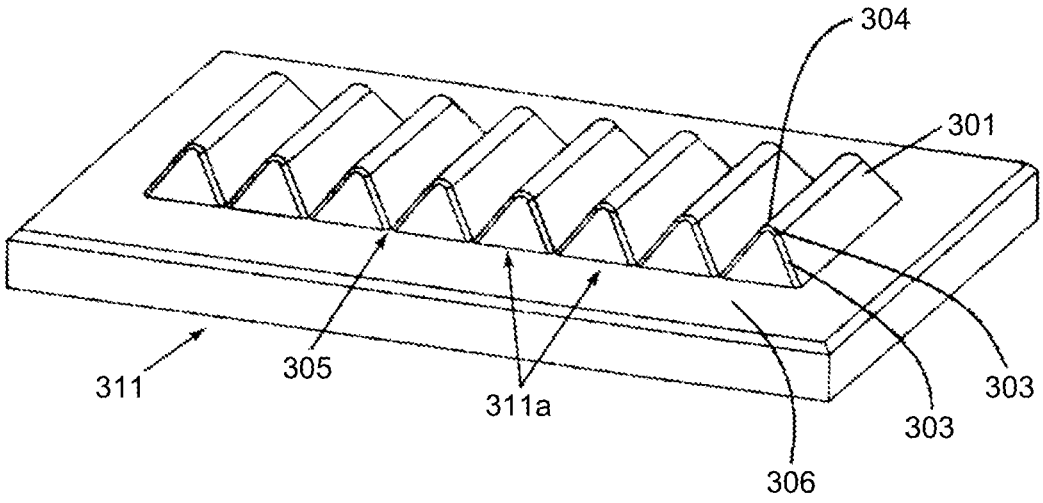
FIG. 33 is a diagram illustrating an another modification example of a shape of the crimping toothed jaw of the binding tool for use in the sheet processing apparatus according to the embodiment.

FIG. 33 is a diagram illustrating a modification of the example illustrated in FIG. 32.

In the example illustrated in FIG. 33, the sides 303 extending between the base 306 and the top-land edges 304 are rounded or chamfered in a plurality of shapes (that differ from one another in radius of curvature, for example) as the damage lessening portion. Accordingly, pressure concentration that would otherwise occur when a pressing force is applied can be prevented more effectively, thereby preventing a sheet stack PB that contacts the teeth from being damaged or torn more efficiently. Consequently, a binding force on the sheet stack PB can be stabilized.

Figure 34:
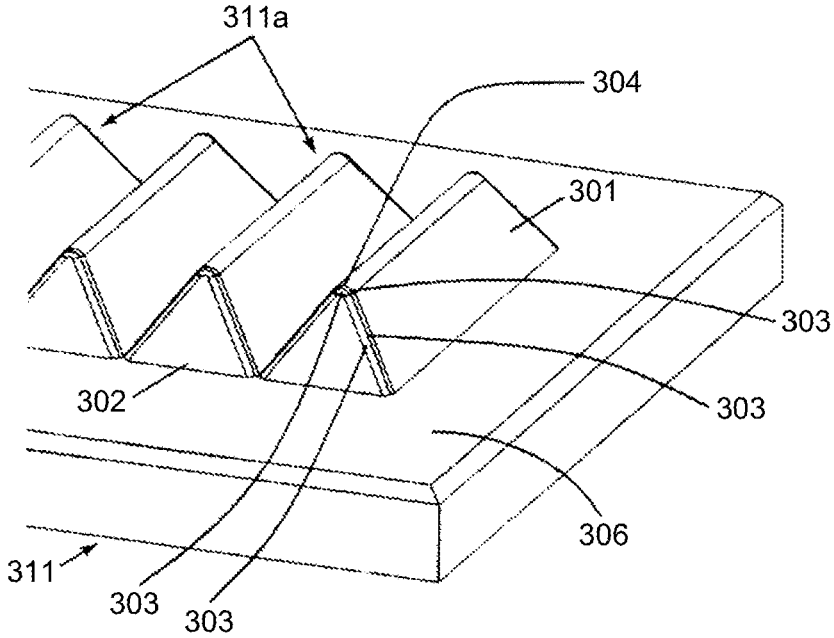
FIG. 34 is a diagram illustrating a configuration modification of the example illustrated in FIG. 33.

FIG. 34 is a diagram illustrating another modification of the configuration illustrated in FIG. 33.

In the configuration illustrated in FIG. 34, the sides 303 are rounded (or chamfered) by applying a plurality of (which is three in the example illustrated in FIG. 34) bevels.

Figure 35:
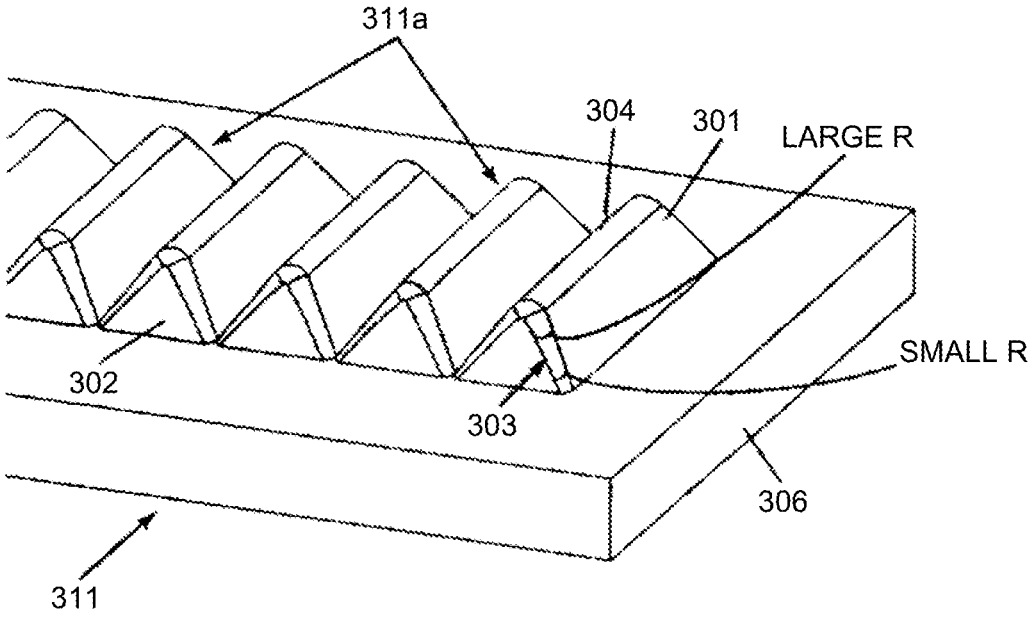
FIG. 35 is a diagram illustrating another configuration modification of the example illustrated in FIG. 33.

FIG. 35 is a diagram illustrating another modification of the configuration illustrated in FIG. 33.

In the configuration illustrated in FIG. 33, if a radius of rounding of the side 303 between the tooth face 301 and the side face 302 is uniform, a force applied to the sheet stack PB contacting the side 303 is large near the top-land edge 304 and small near the base 306. Accordingly, tearing, damage, or a wrinkle of sheets is likely to occur near the edge 304.

In consideration of this, in the configuration illustrated in FIG. 35, a rounding radius of the side 303 at a portion (captioned with "LARGE R") near the top-land edge 304 is larger than that at a portion (captioned with "SMALL R") near the base 306.

This configuration disperses a large force applied to the portion near the top-land edge 304, thereby more reliably preventing sheets from being damaged or torn. Moreover, the sheet stack PB is more effectively prevented from being wrinkled by being deflected when pinched. Accordingly, a binding force on the sheet stack PB can be more stabilized.

Meanwhile, a wrinkle or tearing of a sheet can be caused by a sharp change in pressure at the side 303 extending between the base 306 and the top-land edge 304.

More specifically, a large force is applied to the being-bound sheet stack PB at a portion where the sheet stack PB contacts the tooth face 301. Because a force is not directly applied to the sheet stack PB at a portion where the sheet stack PB is not in contact with the tooth face 301, a sharp change in pressure occurs at the side 303 extending between the base 306 and the top-land edge 304. This sharp change can result in a damage, tearing, or a wrinkle in the sheets.

Tearing, damage, or a wrinkle of a sheet is likely to occur at a portion near the tooth face 301 than the side face 302 of the side 303.

Figure 36:
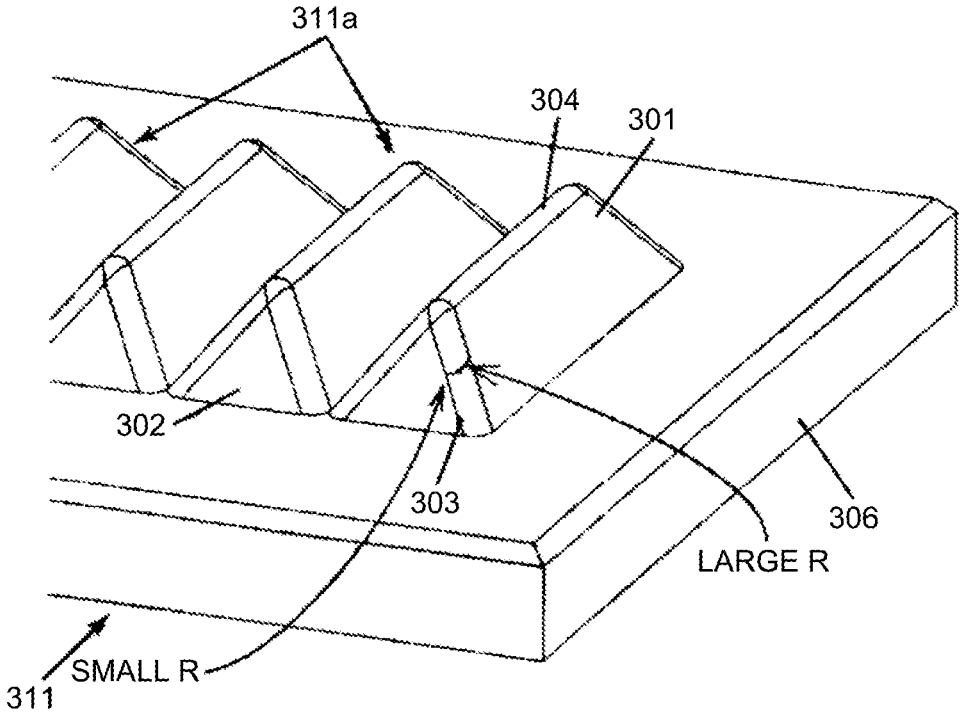
FIG. 36 is a diagram illustrating still an another modification example of a shape of the crimping toothed jaw of the binding tool for use in the sheet processing apparatus according to the embodiment.

In consideration of this, in the configuration illustrated in FIG. 36, a rounding radius of the side 303 at a portion (captioned with "LARGE R") near the tooth face 301 is larger than that at a portion (captioned with "SMALL R") near the side face 302.

Figure 37:
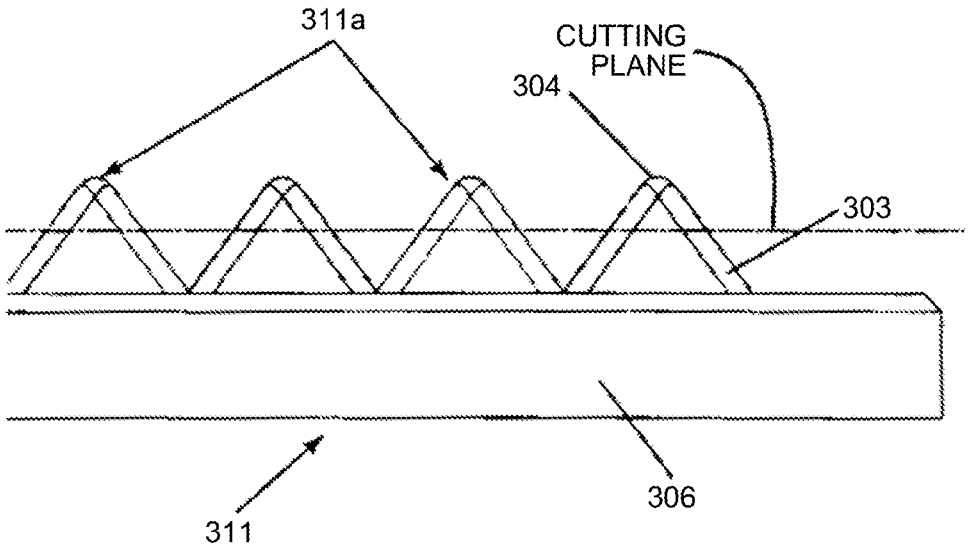
FIG. 37 is a side view of the crimping toothed jaw shown in FIG. 36.

FIG. 37 is a side view of the toothed jaw shown in FIG. 36. Adopting such a configuration causes a force applied to the sheet stack PB to gradually decrease from the tooth face 301 toward the side face 302, whereby the sharp change in pressure at or near the side 303 can be moderated. Accordingly, such a configuration can prevent sheets from being damaged or torn, and also prevent a wrinkle, which can be formed when sheets pinched between the crimping toothed jaws 310 and 311 are deflected, from being formed in the sheet stack PB. As a result, the binding force on the sheet stack PB can be stabilized.

Figure 38:
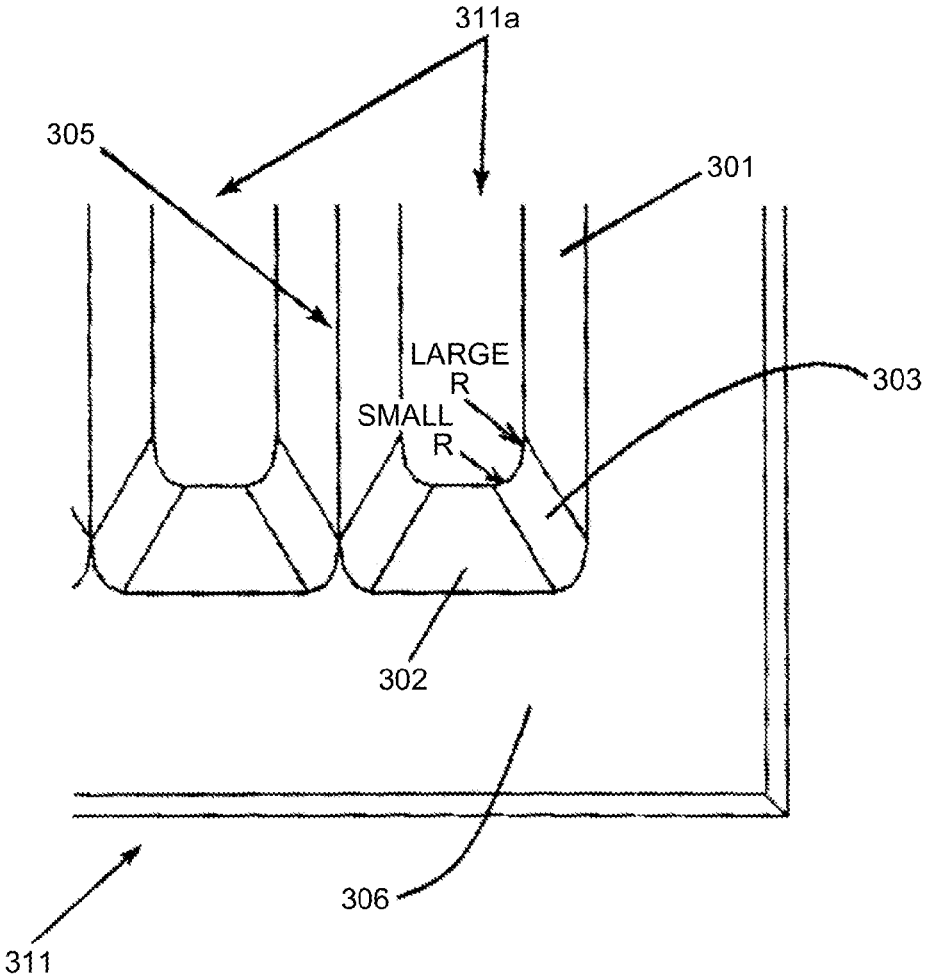
FIG. 38 is a plan view illustrating a cross section, taken along a cutting plane of the crimping toothed jaw shown in FIG. 37, of the example illustrated in FIG. 36.

FIG. 38 is a plan view illustrating a cross section, taken along a cutting plane illustrated in FIG. 37, of the lower toothed jaw 311 described above with reference to FIG. 36. Referring to FIG. 38, the radius of rounding of the side 303 at the portion (captioned with "LARGE R") near the tooth face 301 is larger than that at the portion (captioned with "SMALL R") near the side face 302.

As already described above, an amount of deformation of the sheet stack PB increases toward the outermost tooth in the direction, in which the teeth 311*a* are aligned. The larger the deformation amount, the more likely a wrinkle is formed. Meanwhile, a force is applied to the sheet stack PB at a portion where the outer teeth 311*a* of the aligned teeth 311*a* contact the sheet stack PB; however, a force is not directly applied to the sheet stack PB at a portion outside this contact portion because no tooth is present. This difference in applied force forms a wrinkle in the sheets or the sheet stack PB. Deformation resulting from this wrinkle lengthens along the flank line (the direction in which the top-land edges 304 extends).

Figure 39:
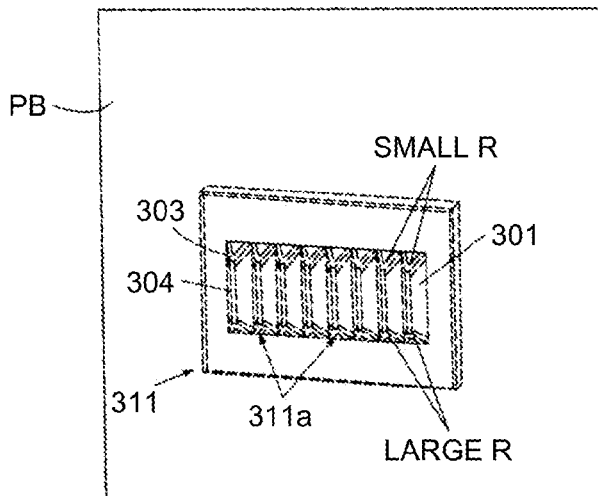
FIG. 39 is a diagram illustrating a shape example of the crimping toothed jaw of a still another example of the binding tool for use in the sheet processing apparatus according to the embodiment.

In consideration of this, as illustrated in FIG. 39, the outermost teeth (captioned with "LARGE R" in FIG. 39) each having one of the sides 303, which extend between the base 306 and the top-land edges 304, where a wrinkle is formed are rounded or chamfered with a rounding radius larger than that of the other inner teeth, or, more specifically, with a largest rounding radius. This configuration decreases the pressure applied onto the sheets from the inner teeth toward the outer teeth, thereby effectively preventing formation of a wrinkle and making a binding force on the sheet stack stabilized.

The foregoing is considered as illustrative only, and it is not desired to limit the invention to the illustrated and described type of the image forming apparatus. Further, numerous modifications and changes within the scope of the invention will occur to those having common general technical knowledge in the art.

As the configuration of the image forming apparatus for use in the image forming system illustrated in FIG. 1 and the configuration of the binding unit, the configurations illustrated in FIGS. 40 to 43 can alternatively be employed.

Figure 40:
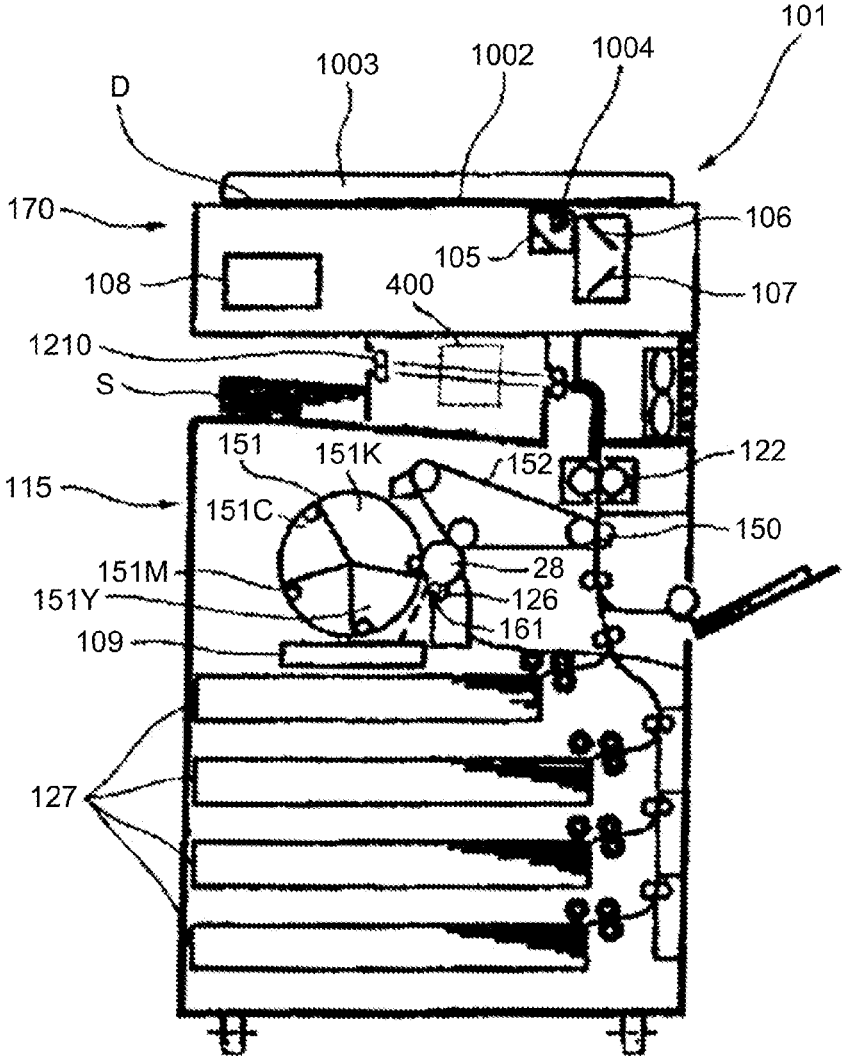
FIG. 40 is a cross-sectional schematic illustrating another example of the image forming apparatus including a sheet binding device.

Referring to FIG. 40, the image forming apparatus 101 includes an image reading unit 170 and an image forming unit 115. A document table 1002, which is a fixed transparent glass plate, is arranged on a top of the image reading unit 170. A document pressing plate 1003 presses and fixes an original document D placed with its image surface facing down on the document table 1002 at a predetermined position. A lamp 1004 that illuminates the document D and reflection mirrors 105, 106, and 107 for transferring an optical image of the illuminated document D to an image processing unit 108 are arranged below the document table 1002. The lamp 104 and the reflection mirrors 105, 106, and 107 are moved at a predetermined velocity to scan the document D.

The image forming unit 115 includes a photosensitive drum 28, a primary electrostatic charging roller 161, a rotary developing unit 151, an intermediate transfer belt 152, a transfer roller 150, and a cleaner 126. A laser unit 109 emits the optical image according to image data onto the photosensitive drum 28 to form electrostatic latent images on the surface of the photosensitive drum 28. The primary electrostatic charging roller 161 electrostatically charges the surface of the photosensitive drum 28 uniformly before laser light is emitted onto the surface. The rotary developing unit 151 causes magenta (M), cyan (C), yellow (Y), and black (K) toners to stick to the electrostatic latent images, respectively, formed on the photosensitive drum 28, thereby forming toner images. The toner images developed on the photosensitive drum 28 are transferred onto the intermediate transfer belt 152. The transfer roller 150 then transfers toner images from the intermediate transfer belt 152 onto a sheet S. The cleaner 126 removes the toner remaining on the photosensitive drum 28 after the toner images are transferred.

The rotary developing unit 151 that employs a rotary development system includes a developing device 151K, a developing device 151Y, a developing device 151M, and a developing device 151C. The rotary developing unit 151 is to be rotated by a motor (not shown). When forming a monochromatic toner image on the photosensitive drum 28, the rotary developing unit 151 is rotated to move the developing device 151K to a developing position in proximity of the photosensitive drum 28, where the developing device 151K performs development. Similarly, when forming a full-color toner image, the rotary developing unit 151 is rotated to sequentially bring the developing devices to the development position, where development is performed one color by one color.

The toner images developed on the photosensitive drum 28 by the rotary developing unit 151 are transferred onto the intermediate transfer belt 152. The toner images on the intermediate transfer belt 152 are transferred onto the sheet S by the transfer roller 150. The sheet S is to be supplied from one of sheet cassettes 127.

A fixing unit 122 arranged downstream of the image forming unit 115 fixes the toner image onto the conveyed sheet S. The sheet S, onto which the toner image has been fixed by the fixing unit 122, is optionally bound by a sheet binding device 400, which will be described later. The sheet or a sheet bundle is ejected to an output unit 125 outside of the apparatus by a pair of ejecting rollers 1210.

Figure 41:
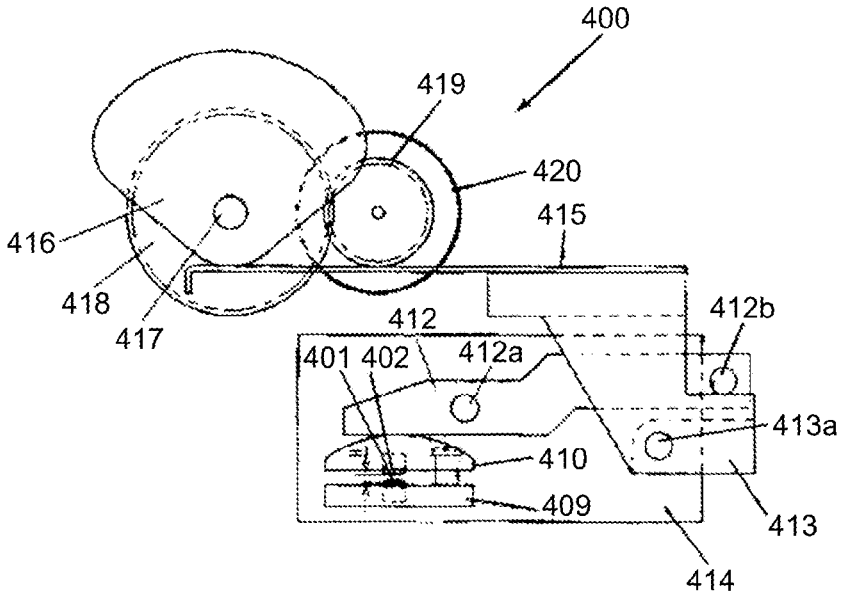
FIG. 41 is a cross-sectional schematic illustrating a configuration of the sheet binding device.
Figure 42:
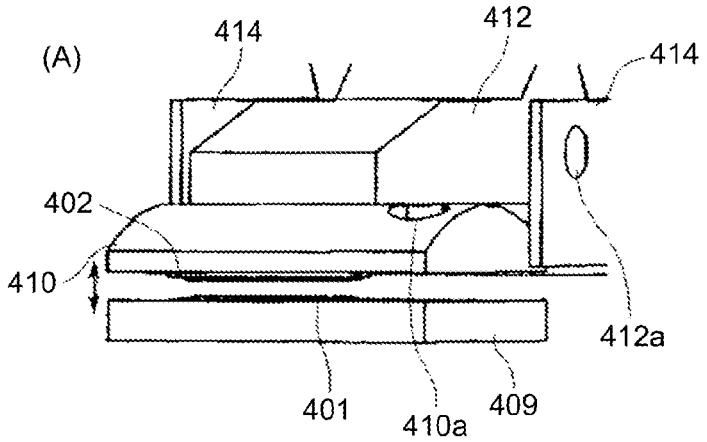
FIGS. 42(A) and 42(B) are an enlarged perspective view of and near a support unit of toothed members of the sheet binding device illustrated in FIG. 41 and a top perspective view illustrating the sheet binding device, from which an upper support is removed, respectively.
Figure 42:
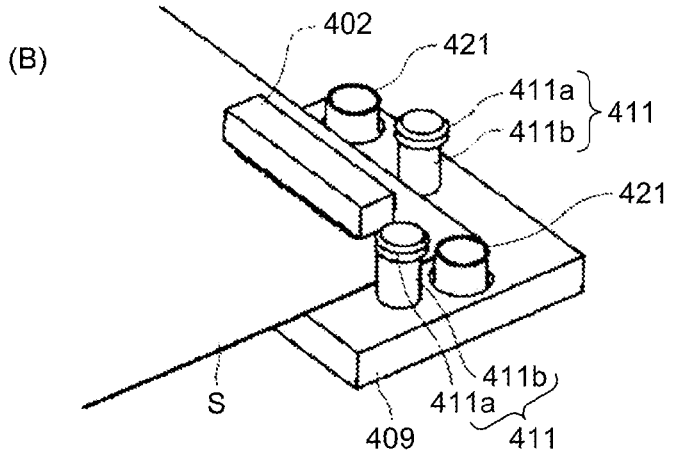
Figure 43:
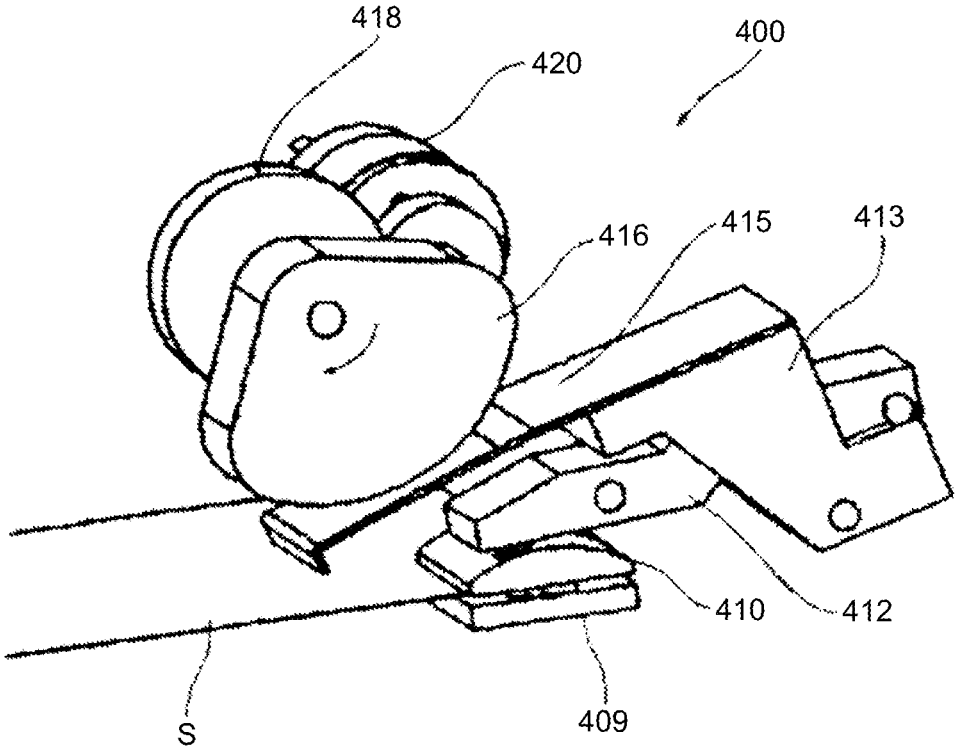
FIG. 43 is a perspective view illustrating the sheet binding device illustrated in FIG. 41 in a binding state.

FIG. 41 is a cross-sectional schematic of a sheet binding device. FIG. 42(A) is an enlarged perspective view of and near a support unit of toothed members of the sheet binding device. FIG. 42(B) is a top perspective view illustrating the sheet binding device, from which an upper support is removed. FIG. 43 is a perspective view illustrating the sheet binding device in a binding state.

As illustrated in FIG. 41, a sheet binding device 400 is a sheet binding device that binds a sheet stack of a plurality of sheets without using a binding member such as a staple. The sheet binding device 400 includes a pair of toothed members 401 and 402 that binds a sheet stack. The pair of toothed members 401 and 402 is arranged to be movable in a thickness direction of the sheet stack. The toothed members 401 and 402 bind the sheet stack by crimping the sheet stack and forming grooves and ridges in the sheet stack in its thickness direction, thereby joining the sheets together.

The toothed member on the lower side (hereinafter, "lower toothed member") 401 is supported by a support on the lower side (hereinafter, "lower support") 409 with a screw or the like. Similarly, the toothed member on the upper side (hereinafter, "upper toothed member") 402 is supported by a support on the upper side (hereinafter, "upper support") 410 with a screw or the like. Each of the toothed members 401 and 402 has a ridge-and-groove shape made up of a series of raised portions and recessed portions arranged with a uniform arrangement pitch. The arrangement pitch means a pitch between adjacent ridges or a pitch between adjacent grooves.

As illustrated in FIG. 42B, the lower support 409 supporting the lower toothed member 401 includes two guide pins 411 for use in positioning a sheet stack between the toothed member 401 and 402 by receiving a corner portion of the sheet stack. As illustrated in FIG. 42A, the upper support 410 supporting the upper toothed member 402 includes guide holes 410*a*, into which the guide pins 411 in the lower support 409 are to be respectively movably engaged to be guided. As illustrated in FIG. 42B, the guide pin 411 includes a guide portion 411*b* for movably guiding the upper support 410 in the thickness direction of the sheet stack and a stopper portion 411*a* for preventing the upper support 410 from coming off from the guide pin 411. The upper support 410 is upwardly urged by compression springs 421 arranged on the lower support 409. Top dead center of the upper support 410 that is upwardly urged is a position where the upper support 410 contacts the stopper portions 411*a* of the guide pins 411 that are larger than a diameter of the guide holes 410*a*. Bottom dead center of the upper support 410 is a position where the lower toothed member 401 and the upper toothed member 402 contact.

As illustrated in FIGS. 42(A) and 42(B), the pair of toothed members 401 and 402 are a fixed toothed member fixed at a predetermined position and a movable toothed member movable relative to the fixed toothed member in the thickness direction of the sheet stack. In this example, the lower support 409 of the lower toothed member 401, which is one of the pair of toothed members 401 and 402, is attached to a frame 414, and accordingly is the fixed toothed member fixed at the predetermined position. The upper support 410 of the upper toothed member 402 is movable along the guide pins 411 in the thickness direction of the sheet stack, and accordingly is the movable toothed member that is movable relative to the lower toothed member 401 in the thickness direction of the sheet stack. A sheet binding unit is made up of the pair of toothed members 401 and 402, the lower support 409, the upper support 410, an arm 412, and the frame 414. The arm 412 is supported on a shaft 412*a* to be pivotable relative to the frame 414. One end of the arm 412 is in contact with a top surface of the upper support 410 that supports the upper toothed member 402. The arm 412 is a moving unit that moves the upper support 410 along the guide pins 411 from a withdrawn position to a binding position by virtue of the compression springs 421 and the guide pins 411. At the withdrawn position, a clearance H between the toothed members 401 and 402 is maximized. At the binding position, the toothed members 401 and 402 are brought into mesh. The binding position is a first position where a sheet stack is pinched and bound by the pair of toothed members 401 and 402. The withdrawn position is a second position where the upper toothed member 402 is withdrawn from the first position with respect to the lower toothed member 401 in the thickness direction of the sheet stack.

As described above, the upper support 410 and the arm 412 in a not-operating state are situated to maximize the clearance H between the pair of toothed members 401 and 402 by virtue of the compression springs 421 and the guide pins 411. As illustrated in FIG. 41, a pressing pin 412*b* for pressing a connecting arm 413 is arranged at the other end of the arm 412. The connecting arm 413 is supported on a shaft 413*a* to be pivotable relative to the frame 414. An arm plate 415, which is an elastic member, is attached to a top of the connecting arm 413. A cam 416 is in contact with a top surface of a free end of the arm plate 415. A vertical position of the arm plate 415 depends on a phase of the cam 416.

Referring to FIG. 41, the cam 416 is driven to pivot by a driving force transmitted from a cam driving motor 420, which is a driving source of the cam 416, via a motor gear 419, a drive transmission gear 418, and a cam driving shaft 417.

Accordingly, when the cam 416 is pivoted, the connecting arm 413, to which the arm plate 415 is attached, and the arm 412 are pivoted. As a result, the upper support 410 including the upper toothed member 402 is moved in the thickness direction of the sheet stack along the guide pins 411 relative to the lower support 409 including the lower toothed member 401. More specifically, when the cam 416 is pivoted from the state illustrated in FIG. 41 to the state illustrated in FIG. 43, the arm 412 is pivoted against the force from the compression springs 421. As a result, the upper support 410 is moved to the binding position where the upper toothed member 402 and the lower toothed member 401 are in mesh.

At this time, a pressing force applied between the toothed members 401 and 402 is constant (approximately 100 kg in this example). When the cam 416 is continuously pivoted from the state illustrated in FIG. 43 to the state illustrated in FIG. 41, the upper support 410 including the upper toothed member 402 is moved to the withdrawn position where the upper support 410 contacts the stopper portions 411*a* of the guide pins 411 by the urging force of the compression springs 421. As described above, driving the cam 416 to make a single revolution causes the pair of the toothed members 401 and 402 to perform the binding.

According to an aspect of the embodiment, because at least one portion of edges of a toothed jaw unit of a binding unit is rounded, a ridgeline is not edged. Therefore, a wrinkle or breakage, or what is referred to as tearing, of a sheet that can be caused if the ridgeline is edged when toothed jaws are brought into mesh is prevented. Accordingly, a decrease in binding strength can be prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a conveying unit configured to convey sheets;

a stacking unit configured to stack the conveyed sheets to form a sheet stack; and a binding unit configured to include a pair of toothed jaws of an upper tooth jaw and a lower tooth jaw arranged to face each other, and bind the sheet stack by pressing the sheet stack between the pair of toothed jaw, wherein at least one of the upper tooth jaw and the lower tooth jaw includes a base, a top-land portion, and side edges between the base and the top-land portion, wherein ridgelines between four sides of the top-land portion and the side edges are rounded, and a rounding radius of the top-land portion is larger than a rounding radius of the side edges.

2. The sheet processing apparatus claim 1, wherein the side edges are rounded in a cross section taken perpendicularly to a direction, in which the toothed jaws are brought into mesh.

3. The sheet processing apparatus according to claim 2, wherein a curved surface corresponding to the rounded cross section is formed by performing any one of cutting and molding using a molding die.

4. The sheet processing apparatus according to claim 1, wherein the toothed jaw includes a crimping tooth and a plurality of rounded portions differing from one another in radius of curvature and serving as a damage lessening portion.

5. The sheet processing apparatus according to claim 4, wherein a portion near a distal end of the crimping tooth and a portion near the base of the toothed jaw are rounded, wherein a radius of curvature of the portion near a distal end is set larger than that of the portion near the base.

6. The sheet processing apparatus according to claim 4, wherein the crimping tooth has a tooth face and a side face, and the radius of curvature of rounding of the damage lessening portion decreases from the tooth face toward the side face.

7. The sheet processing apparatus according to claim 4, wherein the crimping tooth is provided in a plurality, the plurality of crimping teeth being aligned, and outermost one of the crimping teeth is rounded with a largest radius of curvature.

8. An image forming system comprising the sheet processing apparatus according to claim 1.

9. A sheet processing apparatus comprising:

a conveying unit configured to convey sheets;

a stacking unit configured to stack the conveyed sheets to form a sheet stack; and a binding unit configured to include a pair of toothed jaw of an upper tooth jaw and a lower tooth jaw arranged to face each other, and bind the sheet stack by pressing the sheet stack between the pair of toothed jaw, wherein at least one of the upper tooth jaw and the lower tooth jaw includes a base, a top-land portion, and side edges between the base and the top-land portion, wherein ridgelines between four sides of the top-land portion and the side edges are chamfered, and a rounding radius of the top-land portion is larger than a rounding radius of the side edges.

10. An image forming system comprising the sheet processing apparatus according to claim 9.

11. A sheet processing apparatus comprising a binding unit configured to include a pair of toothed jaw of an upper tooth jaw and a lower tooth jaw arranged to face each other, and bind a sheet stack by pressing the sheet stack between the pair of toothed jaw, wherein wherein at least one of the upper tooth jaw and the lower tooth jaw includes a base, a top-land portion, and side edges between the base and the top-land portion, wherein ridgelines between four sides of the top-land portion and the side edges are rounded, and a rounding radius of the top-land portion is larger than a rounding radius of the side edges.

12. The sheet processing apparatus according to claim 11, wherein the side edges are rounded in a cross section taken perpendicularly to a direction, in which the toothed jaws are brought into mesh.

13. The sheet processing apparatus according to any one of claim 11, wherein the toothed jaw includes a crimping tooth and a plurality of rounded portions differing from one another in radius of curvature and serving as a damage lessening portion.

14. The sheet processing apparatus according to claim 13, wherein a portion near a distal end of the crimping tooth and a portion near the base of the toothed jaw are rounded, wherein a radius of curvature of the portion near a distal end is set larger than that of the portion near the base.

15. The sheet processing apparatus according to claim 13, wherein the crimping tooth has a tooth face and a side face, and the radius of curvature of rounding of the damage lessening portion decreases from the tooth face toward the side face.

16. The sheet processing apparatus according to claim 13, wherein the crimping tooth is provided in a plurality, the plurality of crimping teeth being aligned, and outermost one of the crimping teeth is rounded with a largest radius of curvature.

17. An image forming system comprising the sheet processing apparatus according to claim 11.

* * * * *